US006801236B2

(12) United States Patent
Araki et al.

(10) Patent No.: US 6,801,236 B2
(45) Date of Patent: Oct. 5, 2004

(54) PRINTING DEVICE AND PRINTING METHOD

(75) Inventors: Kenichi Araki, Chiba-ken (JP); Yosuke Jojima, Kanagawa-ken (JP); Hiroyuki Mori, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/232,670

(22) Filed: Sep. 3, 2002

(65) Prior Publication Data

US 2003/0058326 A1 Mar. 27, 2003

(30) Foreign Application Priority Data

Sep. 27, 2001 (JP) ..... 2001-298310
Sep. 29, 2001 (JP) ..... 2001-375015

(51) Int. Cl.[7] ..... B41J 13/00; B41J 13/03
(52) U.S. Cl. ..... 347/213; 347/218
(58) Field of Search ..... 367/213, 215, 367/218; 400/120.01

(56) References Cited

U.S. PATENT DOCUMENTS 5,250,133 A 10/1993 Kawamura et al.

FOREIGN PATENT DOCUMENTS

| | | | | |
|---|---|---|---|---|
| JP | 8-25747 | | 1/1996 | |
| JP | 08-043006 | * | 2/1996 | ..... G01B/5/06 |
| JP | 10-53234 | | 2/1998 | |
| JP | 11-254844 | | 9/1999 | |
| JP | 11-263079 | | 9/1999 | |
| JP | 2001-205990 | | 7/2001 | |
| JP | 2002-96510 | | 4/2002 | |
| WO | WO 93/13951 | | 7/1993 | |
| WO | WO 99/32291 | | 7/1999 | |

* cited by examiner

*Primary Examiner*—Huan Tran
(74) *Attorney, Agent, or Firm*—Pillsbury Winthrop LLP

(57) ABSTRACT

A printer device is equipped with a supply shaft and a take-up shaft for conveying an intermediate transfer medium having a transferring layer in a prescribed pattern, a printer portion for printing prescribed information on the transferring layer of the conveyed intermediate transfer medium, a transferring portion for transferring prescribed printed information together with the transferring layer on an image receiving medium, and a pressurization mechanism for press fitting an image receiving medium and the intermediate transfer medium by applying a fixed pressure irrespective of a thickness of an image forming medium.

4 Claims, 13 Drawing Sheets

FIG.6A
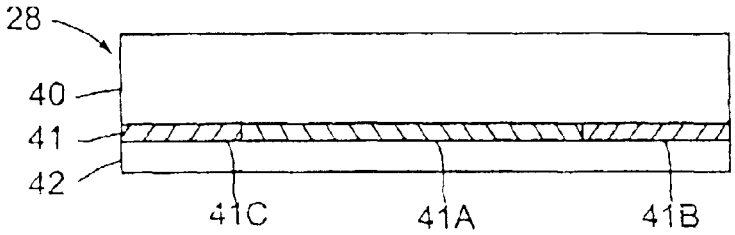
FIG.6B
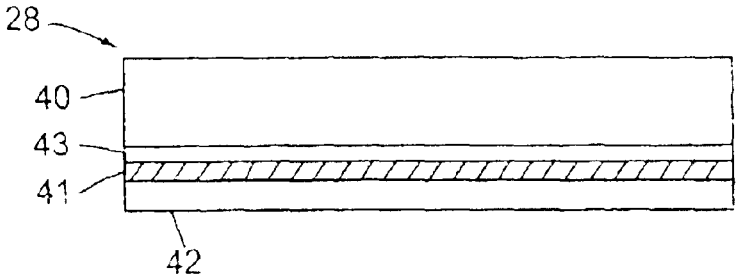
FIG.6C
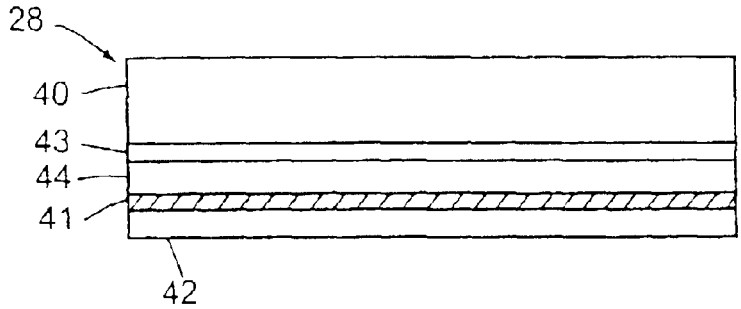
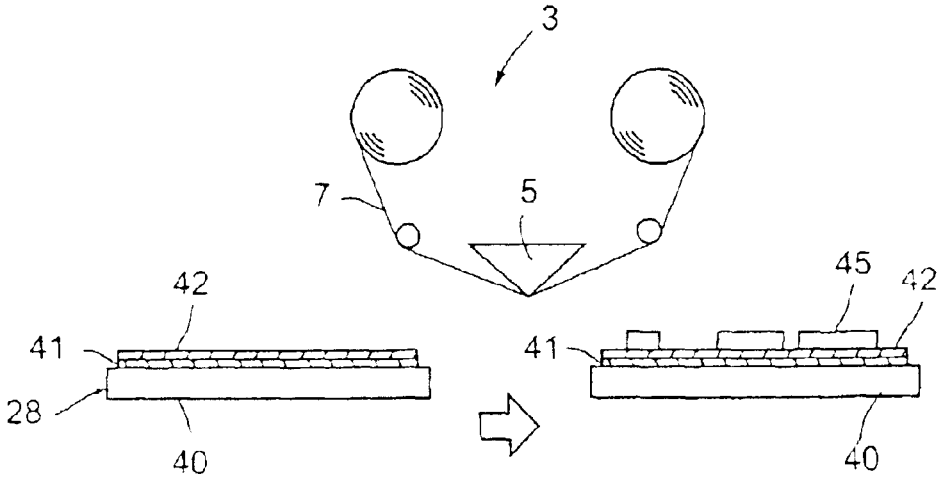
FIG.7

PRINTING DEVICE AND PRINTING METHOD

CROSS-REFERENCE TO RELATED APPLICATIONS

This application is based upon and claims the benefit of priority from the prior Japanese Patent Application No. 2001-298310, filed on Sep. 27, 2001 and Japanese Patent Application No. 2001-375015, filed on Sep. 29, 2001: the entire contents of which are incorporated herein by reference.

BACKGROUND OF THE INVENTION

This invention relates to a printing device and a printing method and, more particularly, to a printing device and a printing method for printing prescribed information on such image receiving media as bank cards, ID cards, booklets, passbooks and so forth.

A printing device that is capable of making a high quality printing without affected by the surface conditions of image receiving media such as cards, passbooks and other media to the extent possible is demanded in recent years. As one of this type of printing devices, a printing device to use an intermediate transfer ribbon as an intermediate transfer ribbon is well known. This type of printing device comprises a printer portion and a transferring portion. The printer portion has a thermal print head and an ink ribbon. The transferring portion has a heat roller and a back-up roller.

The intermediate transfer ribbon is supplied into the printer portion. In this printer portion, the thermal print head is heated according to prescribed information and an ink of the ink ribbon is melted and prints prescribed information such as characters, bar codes, etc. on the surface of an intermediate transfer ribbon.

The intermediate transfer ribbon with prescribed information printed is supplied between the heat roller and the back-up roller in the transferring portion. At this time, an image receiving medium with its transfer surface arranged to face the intermediate transfer ribbon is simultaneously fed between the heat roller and the back-up roller.

The heat roller is rotated in this state and the intermediate transfer ribbon and an image receiving medium are pushed against the back-up roller and heated, and prescribed information is transferred on the surface of the image receiving medium. The intermediate transfer ribbon comprises a long base film and a transferring layer coated on this base film. In the transferring portion, the transferring layer is transferred on an image receiving medium together with the prescribed information printed on the transferring layer.

On the transferring layer or an image receiving medium, prescribed information that are optically read may be printed sometimes. On the other hand, in order for preventing forgery of peculiar prescribed information on an image receiving medium, a protection film given with a transparent hologram in a specified pattern may be coated over an image receiving medium. The printing device described above is capable of printing prescribed information on an image receiving medium and coating a surface protection film at the same time.

Even when image receiving media are in the same kind but different in thickness, a spring force to push down the back-up roller during the transferring is changed by a difference in thickness of image receiving media. This means that the pressure at the time of transfer varies depending on a thickness of an image receiving medium. When the pressure at the time of transfer is changed depending upon an image receiving medium, improper conveyance of an image receiving medium or an intermediate transfer ribbon and improper transfer of prescribed information on an image receiving medium may result.

Further, even in the same book-shaped image receiving medium, if an opened page (a transferring page) differs, the thickness of the medium is varied and accordingly, the pressure (a contracting amount of a spring) at the time of transfer changes and the improper conveyance or improper transfer may result.

Further, when transferring information on an open page of the same book-shaped image receiving medium, a swelling (slackening) may be generated on the seam of the page. When information is transferred under this state, the surface of an image receiving medium may contact the intermediate transfer ribbon, and the protection film of the intermediate transfer ribbon may adhere to the outside of the transfer area of an image receiving medium, for example, the seam area of the page where the swelling is easily generated and the defective transfer may result.

Further, in recent years, bank cards and passbooks may have IC, etc. embedded in many cases and the uneven surfaces of them may cause improper printing when melting and printing information on the surfaces. In addition, when making the printing of high quality images on passbooks, minute uneven surfaces resulted from paper fibers caused deterioration of image quality.

So, a printing technology that is not affected by the surface conditions of card and passbooks as could as possible is demanded and one of this technology, a printing using such the intermediate transfer ribbon as described above is known.

The intermediate transfer ribbon comprises a long base film and a transferring layer coated on this base film. When an image is transferred on an image receiving medium in the transferring portion, the transferring layer is separated and an image is transferred on an image receiving medium together with the transferring layer.

However, when separating the intermediate transfer ribbon and an image receiving medium that are heated and press fitted between the heat roller and the back-up roller at the time of image transfer, if the stiffness of an image receiving medium was weak, the transferring layer with an image printed was not separated satisfactorily from the base film and an image receiving medium was pulled by the intermediate transfer ribbon in the state kept adhered to the transferring layer or an image receiving medium itself was broken. Therefore, there were such problems that it was necessary to use image receiving media made of relatively strong material and the degree of freedom for selection of image receiving media was low and cost increased.

BRIEF SUMMARY OF THE INVENTION

An object of this invention is to provide a printing device and a printing method that are capable of preventing generation of defective conveyance and transfer and assuring printing/transferring prescribed information on a prescribed position of image receiving media and printing high quality images stably irrespective of the surface state of image receiving media.

Further, another object of this invention is to provide a printing device and a printing method capable of promoting the degree of freedom for selecting image receiving media and separating the intermediate transfer ribbon and an image receiving medium satisfactorily when transferring images.

According to this invention, a printing device is provided. This printing device comprises: pressurizing means for press fitting an intermediate transfer medium provided with a transferring layer that has a prescribed pattern and an image receiving medium at a prescribed pressure; adjusting means for adjusting the prescribed pressure applied by the pressurizing means so as to maintain the pressure at a fixed level according to a thickness of the image receiving medium; and transferring means for transferring the transferring layer of the intermediate transfer medium press fitted by the pressuring means on the image receiving medium together with information printed on the transferring layer.

Further, according to this invention, a printing method is provided. This printing method comprises: press fitting an intermediate transfer medium provided with a transferring layer and an image receiving medium at a prescribed pressure; adjusting the prescribed pressure applied in the press fitting step so as to maintain the prescribed pressure at a fixed level; and transferring the press fitted transfer layer of the intermediate transfer medium on the image receiving medium together with information printed on the transferring layer.

Further, according to this invention, a printing device is provided. This printing device comprises: a printer portion to print an image on a transferring layer of an intermediate transfer medium; a transferring portion to transfer the image onto an image receiving medium together with the transferring layer of the intermediate transfer medium by heating and pressurizing the image receiving medium and the intermediate transfer medium having the image printed by the printer portion; a reserving portion to temporarily reserve the intermediate transfer medium and the image receiving medium pass through the transferring portion in the closely fitted state; and a separation mechanism to separate the intermediate transfer medium from the image receiving medium reserved in the reserving portion.

Further, according to this invention, a printing method is provided. This printing method comprises: printing an image on a transferring layer of an intermediate transfer medium; transferring the image onto an image receiving medium together with the transferring layer of the intermediate transfer medium by heating and pressurizing the image receiving medium and the intermediate transfer medium having the image printed in the printing step; temporarily reserving the intermediate transfer medium and the image receiving medium on which the image is transferred in the closely fitted state; and separating the intermediate transfer medium from the image receiving medium reserved in the reserving step.

BRIEF DESCRIPTION OF THE DRAWINGS

FIG. 6A through FIG. 6C are schematic sectional views showing the structure of the intermediate transfer medium that is applicable to the printing device shown in FIG. 1, respectively;

FIG. 7 is a schematic diagram for explaining the printing operation by the printer portion to print prescribed information on the intermediate transfer medium shown in FIG. 1;

DETAILED DESCRIPTION OF THE INVENTION

Figure 1:
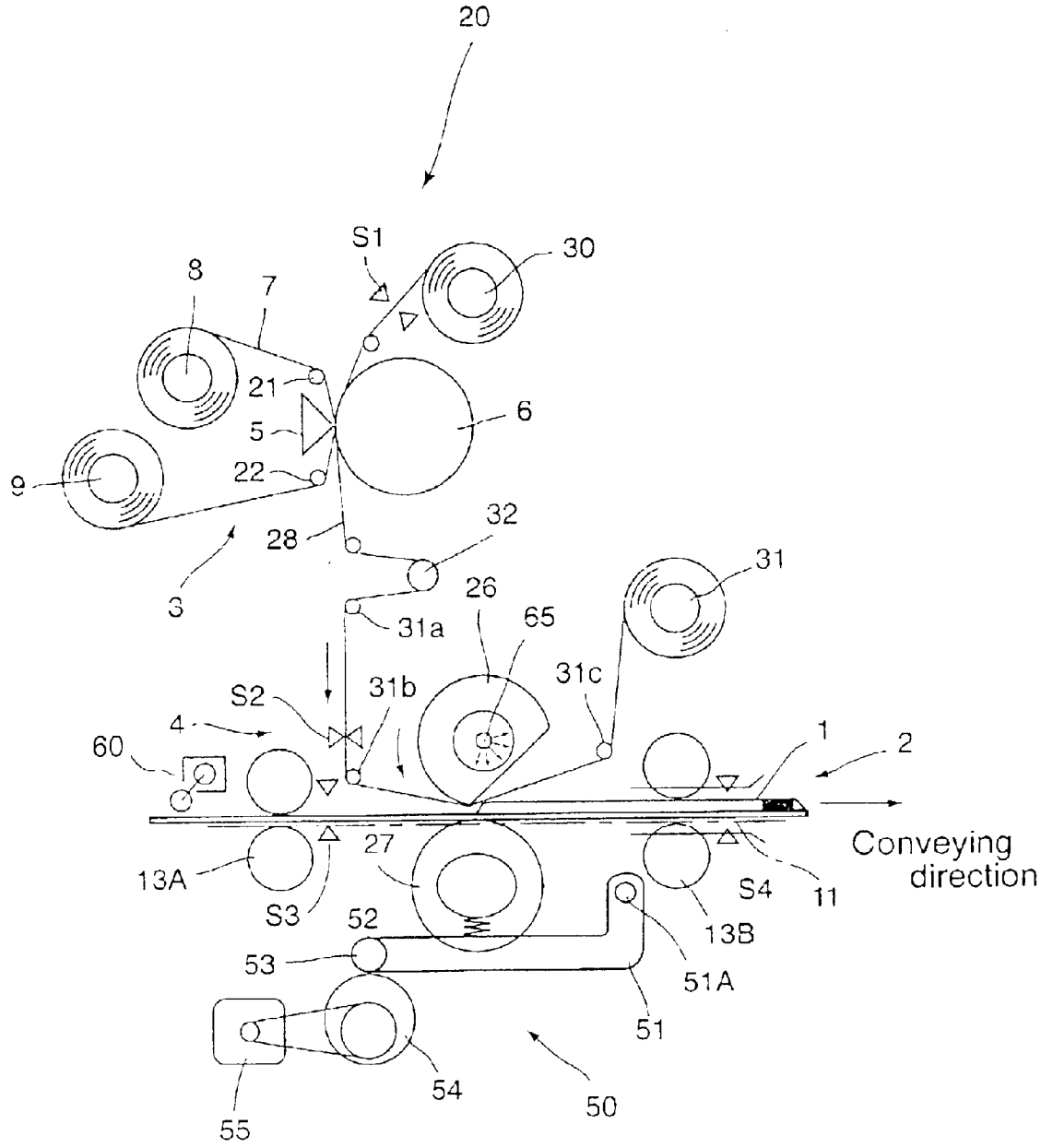
FIG. 1 is a schematic diagram showing the structure of a printing device involved in an embodiment of this invention.

Hereinafter, a printing device and a printing method involved in a first embodiment of this invention will be explained referring to the drawings. This printing device is an intermediate transfer type printing device which executes the printing of prescribed information on image receiving media such as cards, passbooks and so forth, and providing a protection film on the printing surface at the same time.

As shown in FIG. 1, a printing device 20 comprises a printer portion 3 that functions as a printing means and a transferring portion 4 that functions as a transferring means provided below the printer portion 3.

The printer portion 3 is provided with a thermal print head 5, a platen roller 6 and other components that are arranged facing the thermal print head 5. Between the thermal print head 5 and the platen roller 6, there is an ink ribbon 7 that has yellow (Y), magenta (M), cyan (C) and black (K) melting inks.

One end of the ink ribbon 7 is wound round a supply shaft 8 and the other end is wound round a take-up shaft 9. At least either one of the supply shaft 8 and the take-up shaft 9 can be driven independently in both the forward and reverse directions. The middle portion of the ink ribbon 7 supplied from the supply shaft 8 is put over guide shafts 21 and 22.

The ink ribbon 7 may be in a single color only or may be made of such materials having such functions as a fluorescent pigment ink that becomes luminous when ultraviolet rays are applied, a glossy metallic thin film (aluminum vaporized) layer for printing or a hologram layer for printing.

The thermal print head 5 prints prescribed peculiar information, that is, identification information, face image information, etc. from the print starting position of an intermediate transfer ribbon 28 that functions as an intermediate transfer ribbon at a prescribed printing position. The platen roller 6 can be driven independently in both the forward and reverse direction. The platen roller 6 functions as a first conveying means for conveying the intermediate transfer ribbon at a prescribed speed.

The transfer portion 4 has a heat roller 26 as a transferring roller, a back-up roller 27 arranged facing to the heat roller 26, etc. Between the heat roller 26 and the back-up roller 27, there is an intermediate transfer ribbon 28.

The heat roller 26 transfers the prescribed information printed on the intermediate transfer ribbon 28 on an image receiving medium from the transfer start position of the intermediate transfer ribbon 28 at the prescribed transfer position. One end of the intermediate transfer ribbon 28 is wound round the supply shaft 30 provided at the upper side of the printer portion 3 and the other end is wound round the take-up shaft 31 provided at the lower side of the printer portion 3.

At least one of the supply shaft 30 and the take-up shaft 31 can be driven independently in both the forward and reverse directions. Further, the supply shaft 30 and the take-up shaft 31 function as a first conveying means to convey the intermediate transfer ribbon 28 at a prescribed speed toward the print position in the printer portion 3 and the transfer position of the transferring portion 4. The middle portion of the intermediate transfer ribbon 28 supplied from the supply shaft 30 is put over guide shafts 31*a*~31*c* and also, put over a tension roller 32 and is maintained at almost a fixed tension.

Further, the transfer portion 4 is provided with a first conveying roller pair 13A and a second conveying roller pair 13B. The first conveying roller pair 13A is arranged at the upper stream side in the conveying direction from a heat roller 26. The second conveying roller pair 13B is arranged at the downstream side in the conveying direction from the heat roller 26.

The first and second conveying roller pairs 13A and 13B function as a second conveying means to convey an image receiving medium (in this embodiment, a book-shaped passbook with a printing page opened) 1 that is inserted through the take-in port 2 along a conveying oath 11 to a prescribed transferring position by the heat roller 26. These first and second conveying roller pairs 13A and 13B can be driven independently in both the forward and reverse directions.

That is, these first and second conveying roller pairs 13A and 13B are rotated in the forward direction jointly and convey the image receiving medium 1 so that the transfer start position on the printing page of the image receiving medium 1 inserted through the take-in port 2 is aligned with the transfer position by the heat roller 26. Further, these first and second conveying roller pairs 13A and 13B are rotated jointly in the reverse direction and convey the image receiving medium 1 that completed the transfer operation in the transferring portion 4 to the take-in port 2 for discharging.

Further, the transfer portion 4 is provided with a first sensor S1 and a second sensor S2 arranged along the supply path of the intermediate transfer ribbon 28. The first sensor S1 and the second sensor S2 output signals for detecting a bar mark arranged outside an effective area of the intermediate transfer ribbon 28, which will be described later.

Further, the transfer portion 4 is provided with a third sensor S3 and a fourth sensor S4 arranged along the conveying path 11 of an image receiving medium 1. The third sensor S3 and the fourth sensor S4 output signals for detecting the presence of an image receiving medium 1 inserted through the take-in port 2.

Further, these first through the fourth sensors S1 through S4 are, for example, transmittance type sensors and equipped with a pair of light emitting portion and light receiving portion but they can be composed of reflection type sensors.

Figure 2:
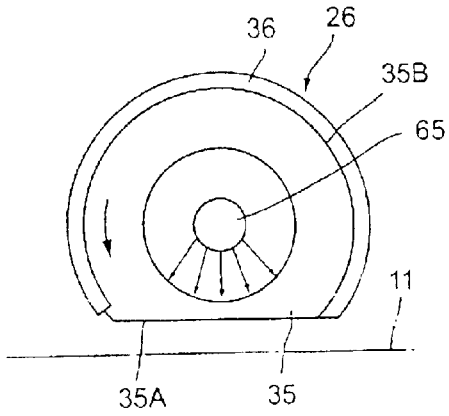
FIG. 2 is a schematic diagram showing the structure of a heat roller applied to the printing device shown in FIG. 1.

The heat roller 26 has the almost semicircular section in the plane that is vertical to the rotating shaft as shown in FIG. 2. The heat roller 26 has a core metal 35. This core metal 35 has a cut surface 35A that is cut to a plane shape on a part of its outer surface. In the inside of the core metal 35, a heater 65 is provided as a source of heat. The outer surface of an arc portion 35B of the core metal 35 is covered by a 1–2 mm thick heat resistance rubber 36.

Further, the heat resistance rubber 36 can be used to cover not only the arc portion 35B of the core metal 35 but also the whole outer surface including the cut surface 35A. In addition, the heat roller 26 may have the core metal only without the heat resistance rubber. In this case, it is desirable to apply the Teflon (the product name of du Pont) process to the surface of the heat roller to prevent adhesion of dirt. Further, the length of the heat roller 26 is formed in the length along the circumferential direction of the arc portion 35B almost equal to the length of the transfer area of the image receiving medium 1.

The heat roller 26 is arranged almost in parallel with the conveying path 11 by facing the cut surface 35A as shown in FIG. 2. Thus, a clearance is formed between the heat roller 26 and the back up roller 27 enough to insert the image receiving medium 1. At this time, it is desirable to arrange the intermediate transfer ribbon 28 at a position where it does not contact the heat roller 26 and the back up roller 27 and also, the surface of an image receiving medium 1 that is entering when the printing starts.

These heat roller 26 and the back-up roller 27 are constructed so as to press fit the intermediate transfer ribbon 28 and an image receiving medium 1 at a fixed pressure by a pressurization mechanism 50 that functions as a pressurizing means at the time of transfer at the transferring position irrespective of a thickness of an image receiving medium.

That is, the pressurization mechanism 50 is equipped with an arm 51 that is provided vertically movable with its one end as a fulcrum 51A and a spring 52 that is provided between the arm 51 and the back-up roller 27 to press the back-up roller 27 toward the heat roller 26 at a prescribed pressure required at the time of transfer.

Further, the pressurization mechanism 50 has a cam follower 53 provided at the other end of the arm 51 as an adjusting means for adjusting to maintain the prescribed pressure applied to the pressuring mechanism 50 according to the thickness of an image receiving medium 1, a cam 54 that is provided rotatably to engage with the cam follower, and a driving motor 55 to rotate the cam 54.

In the pressurization mechanism 50, the driving of the driving motor 55 is controlled based on information corresponding to a thickness of an image receiving medium 1 and the cam 54 is rotated only by a prescribed angle. When the cam 54 is rotated, the cam follower follows and the arm 51 is rotated vertically on the fulcrum 51A. Accompanied with the rotation of the arm 51, the back-up roller 27 is swung by the spring 52 in the vertical direction, that is, in the direction to close to or separate from the heat roller 26. As a result, the gap between the heat roller 26 and the back-up roller 27 is varied according to a thickness of an image forming medium.

Figure 3:
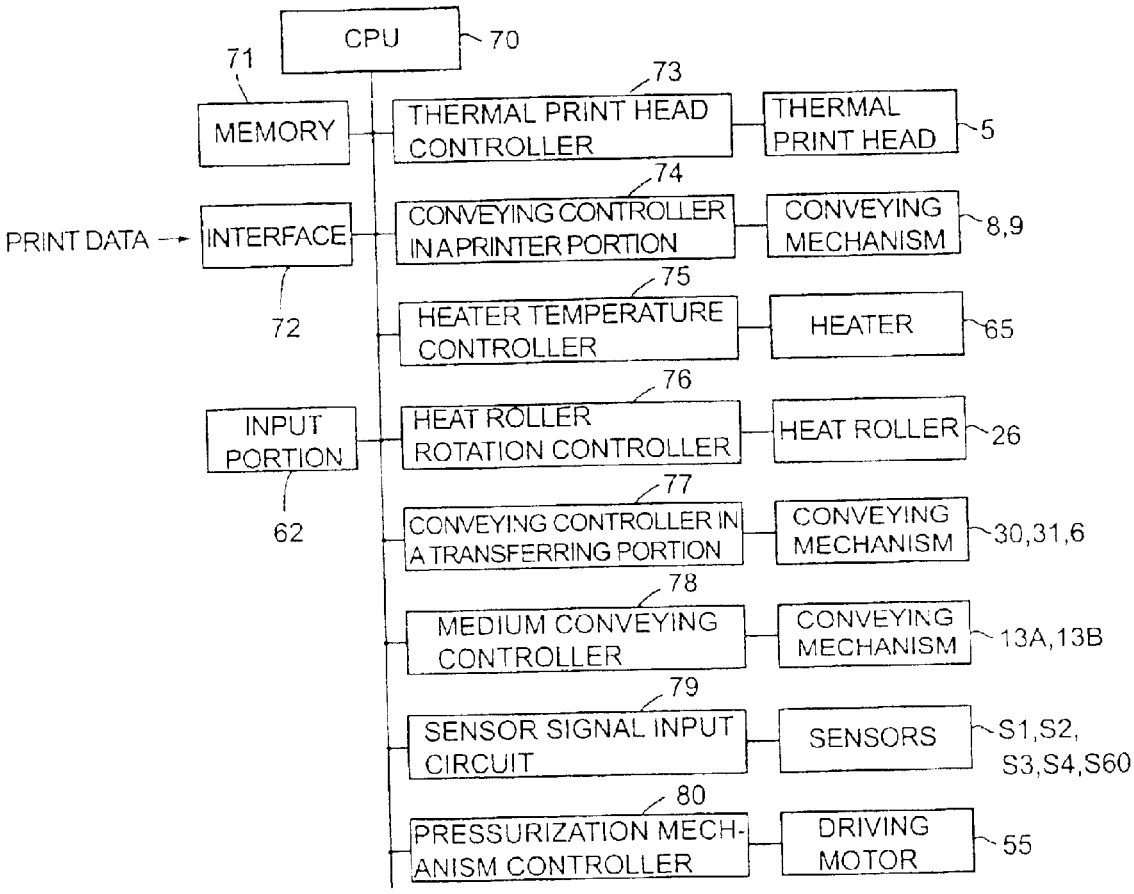
FIG. 3 is a block diagram showing the structure of a control system in the printing device shown in FIG. 1.

The printing apparatus 20 is equipped with a CPU 70 that functions as a control means for controlling the entire device as shown in FIG. 3.

The CPU 70 is connected with a memory 71, an interface 72, an input portion 62 and so forth. The interface 72 receives print data required for the printing from an external equipment such as a host computer, etc. The input portion 62 functions as an information acquiring means to acquire thickness information corresponding to a thickness of an image receiving medium 1 and accepts, for example, input of information corresponding to a thickness of an information receiving medium 1 by operator.

The memory 71 is storing a control program for controlling the driving of the entire device. In addition, the memory 71 stores print data received through the interface 72 and data corresponding to a thickness of an image receiving medium 1 acquired through the input portion 62 temporarily. Further, the memory 71 stores a data table relative to rotating angles of the cam 54 for forming a gap between the heat roller 26 and the back-up roller 27, that is optimum for an image receiving medium 1.

Further, CPU 70 is further connected with a thermal print head controller 73, a conveying controller in a printer portion 74, a heat temperature controller 75, a heat roller rotation controller 76, a conveying controller in a transferring unit 77, a medium conveying controller 78, and a pressurization mechanism controller 80.

The thermal print head controller 73 controls the printing operation of the thermal print head 5 based on printing data.

The conveying controller in a printer portion 74 controls the driving of the supply shaft 8 and the take-up shaft 9 which function as the conveying mechanisms in the printer portion 3.

The heat temperature controller 75 drives the heater 65 in the heat roller 26 to maintain the heat roller 26 at a specified temperature.

The heat roller rotation controller 76 controls the driving and rotation of the heat roller 26. That is, the heat roller rotation controller 76 transfers prescribed information on an image receiving medium 1 on the intermediate transfer ribbon 28 by rotating the heat roller 26 in the prescribed direction after bringing the edge portion of the cut surface 35A of the heat roller 26 in contact with the transfer start position in the state wherein the transfer start position of the image receiving medium is aligned with the prescribed information transfer position printed on the intermediate transfer ribbon 28 by the heat roller 26.

The conveyer controller in a transferring unit 77 controls the driving of the platen roller 6, the supply shaft 30 and the take-up shaft 31 which function as a first conveying mechanism in the transferring portion 4.

The medium conveyer controller 78 functions as a drive control means to control the driving of the conveying roller pairs 13A and 13B that function as a second conveying mechanism, takes in an image receiving medium 1 from the take-in port 2 and conveys it to a prescribed transfer position, and discharges the transfer completed image receiving medium 1 from the take-in port 2. This medium conveying controller 78 rotates the first and second conveying roller pairs 13A and 13B in the reverse direction each other so as to suppress the slacking of the page seam of the image receiving medium 1 with a prescribed printing page opened for the image receiving medium 1 conveyed to a prescribed printing position.

The sensor signal input circuit 79 detects the bar marks of the intermediate transfer ribbon 28 according to the output signals from the first sensor and second sensor S1 and S2. Further, the sensor signal input circuit 79 detects the presence of an image receiving medium 1 based on the output signals from the third and fourth sensors S3 and S4.

The sensor signal input circuit 79 is further connected with a thickness sensor 60 that functions as a sensor to output a signal for detecting a thickness of a printing page of an image receiving medium 1 (a thickness of a printing page when an image receiving medium is a passbook with a prescribed printing page opened). The sensor signal input circuit 79 detects a thickness of an image receiving medium 1 based on the output signal from the thickness sensor 60. The thickness sensor 60 is provided near the first conveying roller pair 13A as shown in FIG. 1 and detects the thickness by a vertically moving distance of the rollers contacting the surface of the inserted image receiving medium 1.

A pressurization mechanism controller 80 rotates the cam 54 by a prescribed rotating angle by controlling the driving of the driving motor 55 so as to form the optimum gap between the heat roller 26 and the back-up roller 27 by referring to the data table stored in the memory 71 according to data corresponding to a thickness of an image receiving medium 1 acquired through the input portion 62 and a thickness of an image receiving medium 1 detected through the thickness sensor 60. Thus, it becomes possible for the heat roller 26 and the back-up roller 27 to pressurize the intermediate transfer ribbon 28 and an image receiving medium 1 present between these heat roller 26 and the back-up roller 27 at a fixed pressure irrespective of a thickness of an image receiving medium 1.

Next, the printing method that is applied to the printing device described above will be explained.

Figure 4:
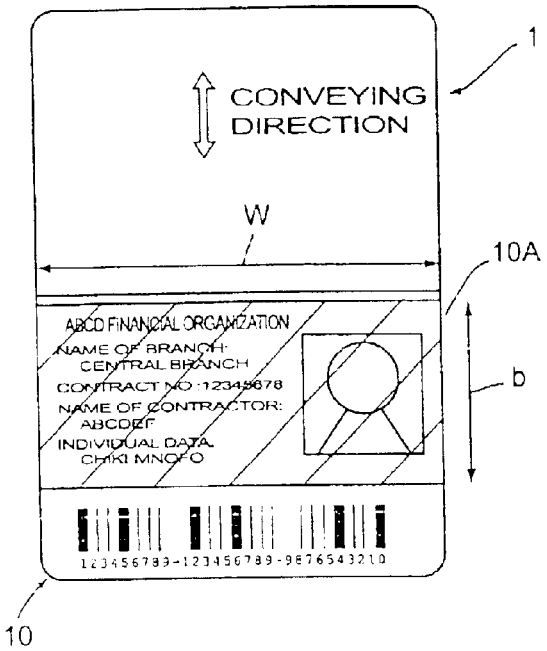
FIG. 4 is a plan view showing one example of an image receiving medium having prescribed information printed/transferred by the printing device shown in FIG. 1 and a protection film.

According to this printing method, a protection film given with a transparent hologram layer having a prescribed pattern is coated over at least a part of an image receiving medium 1; for example, the print area 10A of the print page 10 of an image receiving medium 1 as shown in FIG. 4A.

That is, in this printing method, prescribed information such as peculiar identification information, face image information, etc. are first printed in the print area 10A. Then, a protection film given with a transparent hologram layer having a prescribed pattern is coated over the entire length b and width w along the conveying direction of the print page 10.

Next, the structure of the intermediate transfer ribbon that is applied to the printing device described above will be explained.

That is, as shown in FIG. 6A, the intermediate transfer ribbon 28 is, for example, in a three-layer structure and is composed of a base layer 40, a hologram layer 41 arranged on the base layer, and an adhesion layer 32 that functions as an image receiving layer and is arranged on the hologram layer 41. Prescribed information is printed on the adhesion layer 41 by the printer portion 3.

Out of three layers of the intermediate transfer ribbon 28, the hologram layer 41 and the adhesion layer 42 function as a transferring layer and are transferred on an image receiving medium 1 in the transferring portion 4 together with the prescribed information printed on the adhesion layer 42. The hologram layer 41 that is arranged on the top layer when transferred on an image receiving medium 1 functions as a protection film.

Further, the intermediate transfer ribbon 28 is not restricted only to the structure shown in FIG. 6A but may be in such the structure that a separation layer 43 is arranged between he base layer 40 and the hologram layer 41. In this structure, the separation layer 43, the hologram layer 41 and the adhesion layer 42 function as a transferring layer.

Further, the intermediate transfer ribbon 28 may be in a structure that the separation layer 43, the protection layer 44, the hologram layer 41 and the adhesion layer are laminated in this order on the base layer 40 as shown in FIG. 6C. In this structure, the separation layer 43, the protection layer 44, the hologram layer 41 and the adhesion layer 42 function as a transferring layer.

Figure 5:
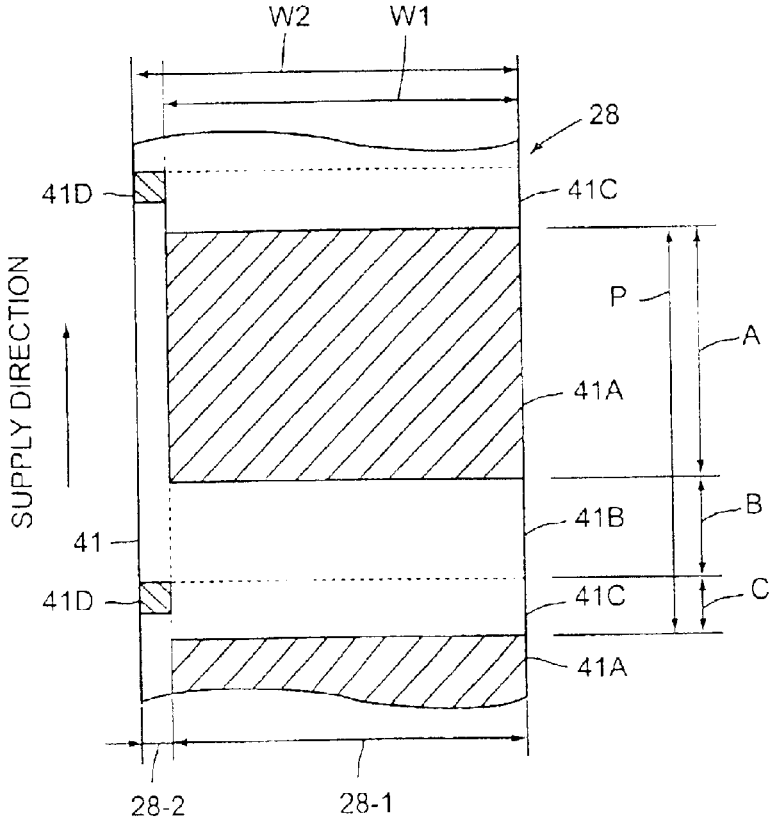
FIG. 5 is a plan view schematically showing the structure of an intermediate transfer medium that is applied to the printing device shown in FIG. 1.

The hologram layer 41 of the intermediate transfer ribbon 28 has a first area 41A comprising a transparent hologram layer in a prescribed pattern, the blank transparent second area 41B, and the third area 41C that is equivalent to a margin as shown in FIG. 5 and FIG. 6A. The first area 41A, the second area 41B, and the third area 41C are arranged in order along the conveying direction of the intermediate transfer ribbon 28 and form a unit pattern.

Further, the hologram layer 41 of the intermediate transfer ribbon 28 has a bar mark 41D for defining the unit pattern comprising the first area 41A, the second area 41B, and the third area 41C. This bar mark 41D is provided in the area 28-2 outside the effective area 28-1 of the intermediate transfer ribbon 28.

That is, the first area 41A of the hologram layer 41 is an area having the diffraction effect to diffract the incident light from a prescribed first direction in a second direction. For a pattern itself, for example, a character, picture, logo, etc. can be freely designed; however, when the forgery preventing effect of printed information is taken into consideration, it is desirable that a pattern is formed on the whole surface as could as possible.

The second area 41B has no effect to diffract rays of light in the visible light area and its neighboring frequency band in the hologram layer 41 and is almost a visually transparent area. The third area 41C is an area equivalent to a margin with the shift of a transfer position taken into consideration and almost a visually transparent area having no diffraction effect likewise the second area 41B.

The bar mark 41D is arranged repeatedly for every unit pattern and has a prescribed pattern having the diffraction effect. This bar mark 41D is detected by the first sensor S1 and the second sensor S2 of the printer device. That is, it becomes possible for the printer device to detect the position of the intermediate transfer ribbon 28 by detecting this bar mark 41D.

Further, the bar mark 41D is arranged in the area 28-2 outside the effective area 28-1. That is, the outside area 28-2 is a visually almost transparent area having no diffraction effect and is not provided in any other place than the bar mark 41D along the conveying direction of the intermediate transfer ribbon 28. Therefore, the printer device is enabled to surely detect the bar mark 41D based on the output signals from the first sensor S1 and the second sensor S2 arranged to face the outside area 28-2 of the intermediate transfer ribbon 28.

The unit pattern comprising the first area 41A, the second area 41B, and the third area 41C is provided at a pitch P along the conveying direction of the intermediate transfer ribbon 28 as shown in FIG. 5.

The first area 41A is formed in a rectangular shape extending over the length A and the width W1 of the effective area 28-1 along the conveying direction. The first area 41A has the length A slightly longer than the length of the conveying direction of the print area 10A in an image receiving medium 1 equivalent to the maximum transfer length. Further, the width W1 of the firs area 41A has a length nearly equal to or longer than the width w of an image receiving medium 1.

The second area 41B is formed in a rectangular shape extending over the length B along the supply direction and the width W of the intermediate transfer ribbon 28. The third area 41C is formed in a rectangular shape extending over the length C and the width W1 of the effective area 28-1 along the conveying direction.

Thus, the length and width of the first through third areas are set as described above, it becomes possible surely to cover the print area 10A of an image receiving medium 1 with a protection film given with the hologram layer in a prescribed pattern.

Next, the printing operation to the intermediate transfer ribbon 28 by the printer portion 3 of the printing device will be explained.

That is, the CPU 70 of the printing device controls the conveying controller in a transferring unit 77, drives the platen roller 6, the supply shaft 30 and the take-up shaft 31 that comprise the first conveying mechanism, and supplies the intermediate transfer ribbon 28 based on the instruction received for starting the printing. Then, the CPU 70 detects the bar mark 41D of the supplied intermediate transfer ribbon 28 according to the output signal from the first sensor S1 through a sensor signal input circuit 79.

Then, the CPU 70 calculates a supply amount of the intermediate transfer ribbon 28 from a reference position of the bar mark 41D based on the printing data using the detected position of the bar mark 41D. That is, the CPU 70 calculates an supply amount of the intermediate transfer ribbon 28 from the position of the bar mark 41D detected at the first sensor S1 to the print start position by the thermal print head 5 at which the specified position arrives.

Then, the CPU 70 controls the conveying controller in a transferring unit 77 based on the calculated supply amount of the intermediate transfer ribbon, drives the platen roller 6, the supply shaft 30 and the take-up shaft 31, supplies the intermediate transfer ribbon 28 by a prescribed supply amount and moves the prescribed printing position of the intermediate transfer ribbon 28 to the print start position by the thermal print head 5.

Then, the CPU 70 controls a thermal print head controller 73 based on the printing data, drives the thermal print head 5 and prints color or black prescribed information by transferring inks of the ink ribbon 7 from the print start position on the adhesion layer 42 of the intermediate transfer ribbon as shown in FIG. 7. That is, thermal print head 5 is heated based on the printing data, and the inks of the ink ribbon 7 are melted and transferred on the surface of the adhesion layer 42 of the intermediate transfer ribbon 28.

Prescribed information that is printed can be in a single color of black or multi-colors of yellow, magenta, cyan and black colors superposed. When necessary, a single color ink ribbon or multi-colors ink ribbons can be coated repeatedly. Further, a melted black ink may be used for printing characters, and yellow, magenta, cyan and black sublimation dyes can be coated repeatedly for the color printing. In the case of the multi-color superpose printing, the printing is made by moving the intermediate transfer ribbon 28 to and from the thermal print head 5 by the same number of times as the number of colors. The conveying speed of the intermediate transfer ribbon 28 is determined mainly by the platen roller 6 and therefore, the platen roller 6 is driven accurately in combination of a 5-phase stepping motor with a reduction mechanism. Further, it is a feature that the printed prescribed information is a reversed image.

Next, the transfer operation of prescribed information to an image receiving medium 1 by the transferring portion 4 of the printing device will be explained. In this embodiment, the adhesion layer 42 of the intermediate transfer ribbon 28 that has the prescribed data printed in the printer portion 3 is put over the applicable printing page 10 of the passbook 1, and the adhesion layer 42 and the hologram layer 341 are transferred at the same time on the passbook 1 together with the prescribed data.

Figure 8A:
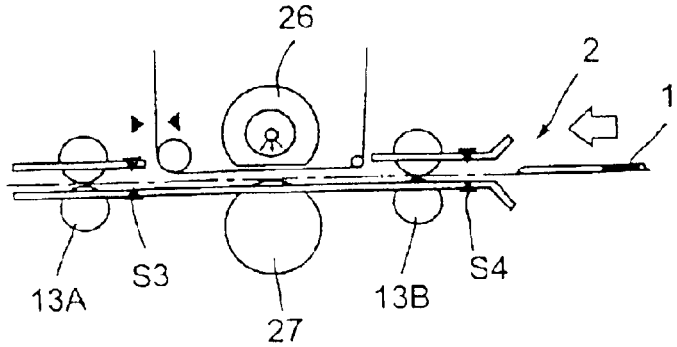
FIG. 8A through FIG. 8D are diagrams for explaining the transfer operation by the transferring portion to transfer prescribed information on the intermediate transfer medium on an image receiving medium shown in FIG. 1.

That is, as shown in FIG. 8A, when the CPU 70 of the printer device detects the insertion of the passbook 1 into the take-in port 2 based on the output signal from the fourth sensor S4 through the sensor signal input circuit, controls the medium conveying controller 78, drive the first conveying roller pair 13A and the second conveying roller pair 13B which comprise the conveying mechanism in the same direction (the forward direction) and conveys the passbook 1 with the print page 10 opened to the transferring position.

At this time, the passbook 1 is conveyed in the direction vertical to the seam. Further, the heat roller 26 is in the print waiting state as shown in FIG. 2 and the cut surface 35A is arranged facing to the conveying path 11 almost in parallel with it. Further, at this time, the back-up roller 27 is arranged at a waiting position away from the heat roller by a prescribed distance.

Figure 8B:
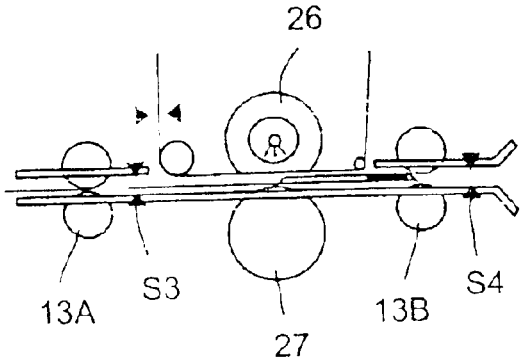

Then, as shown in FIG. 8B, when the leading portion of the passbook 1 is detected according to the output signal from the third sensor 3 through the sensor signal input circuit 79, the CPU 70 once stops to drive the first conveying roller pair 13A and the second conveying roller pair 13B by controlling the medium conveying controller 78.

Then, the CPU 70 controls the medium conveying controller 78 to align the transfer start position on the passbook 1 with the transfer position in the transfer portion 4 based on the printing data, etc. and finely adjust the position of the passbook 1 by driving the first conveying roller pair 13A and the second conveying roller pair 13B in the forward or reverse direction. That is, the passbook 1 is positioned so that the edge portion of the cut surface 35A of the heat roller 26 is brought in contact with a portion near the seam of the printing page 10.

On the other hand, the CPU 70 controls the conveying controller in a transferring unit 77 based on the received direction for starting the print, drives the platen roller 6, the supply shaft 30 and the take-up shaft 31 and sends out the intermediate transfer ribbon having prescribed information printed in the printer portion 3. Then, the CPU 70 detects the bar mark 41D of the intermediate transfer ribbon 28 that is sent out according to the output signal from the second sensor S2 via the sensor signal input circuit 79.

Then, using the position of the detected bar mark 41D as the reference, the CPU 70 calculates a supply amount of the intermediate transfer ribbon 28 from the reference position of the bar mark 41D according to the printing data and the printing mode. That is, the CPU 70 calculates the supply amount of the intermediate transfer ribbon 28 from the position wherein the bar mark 41D is detected by the second sensor S2 to the transfer position of the heat roller 26 at which the prescribed position of the intermediate transfer ribbon 28 arrives.

In succession, the CPU 70 drives the platen roller 6, the supply shaft 30 and the take-up shaft 31 by controlling the conveying controller in transferring unit 77 based on the calculated supply amount, supplies the intermediate transfer ribbon 28 by the prescribed supply amount and have the prescribed printing position arrive at the transfer position in the transferring portion 4.

Figure 8C:
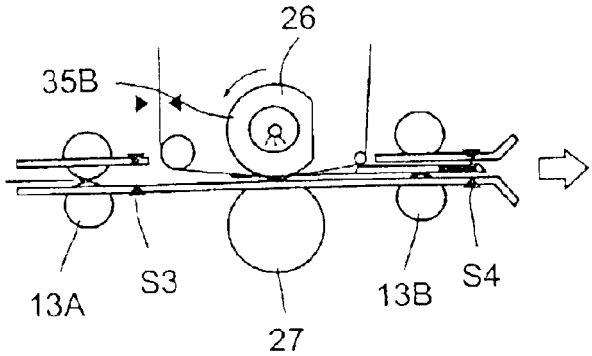

Then, the CPU 70 drives the heater 65 by controlling the heat temperature controller 75 and heats the heat roller 26 to a prescribed temperature as shown in FIG. 8C. Then, the CPU 70 rotates the heat roller 26 by controlling a heat roller rotation controller 76 at a prescribed timing.

That is, the intermediate transfer ribbon 28 and the passbook 1 are superposed each other with the rotation of the heat roller 26 that has the partially cut surface 35A on the circumference. At this time, the transferring is started with the intermediate transfer ribbon and the passbook superposed each other so that the seam portion of the printing page 10 of the passbook 1 becomes in parallel to the cross direction orthogonal to the conveying direction of the intermediate transfer ribbon 28.

At the same time, the passbook 1 is conveyed by the conveying roller pairs 13A and 13B and the intermediate transfer ribbon 28 is conveyed by the supply shaft 30, the take-up shaft 31 and the platen roller 6. At this time, both the intermediate transfer ribbon 28 and the passbook 1 are heated under pressure by the heat roller and the back-up roller 27.

Thus, the adhesion layer 42 with the prescribed information printed and the hologram layer 41 are transferred on the printing surface 10 of the passbook 1. Further, in this embodiment the heat roller 26 can be driven at a more accurate fixed speed using a DC servo motor or a stepping motor and the pressure generated by a coil spring is applied between the heat roller 26 and the freely rotating back-up roller.

This transferring process is explained below more in detail. The CPU 70 controls a pressurization mechanism controller 80 referring to the data table stored in the memory 71 based on thickness information corresponding to the thickness of the printing page of the passbook 1 acquired through the input portion 62 or the thickness of the printing page of the passbook 1 detected by the thickness sensor 60.

Then, the pressurization mechanism controller 80 drives the driving motor 55 under the control of the CPU 70 and rotates the cam 54 by a prescribed rotating angle. When the cam 54 is rotated, the cam follower is rotated following it and the arm 51 is moved upward on the fulcrum 51A. Pursuant to this, the back-up roller 27 swings upward from the waiting position, that is, in the direction to approach the heat roller 26 and then, rotates the heat roller 26.

As described above, a difference in pressure (the contacting amount of the spring) generated from a difference in thickness of a passbook 1 can be absorbed by changing the upper and lower positions of the back-up roller 27.

Figure 9A:
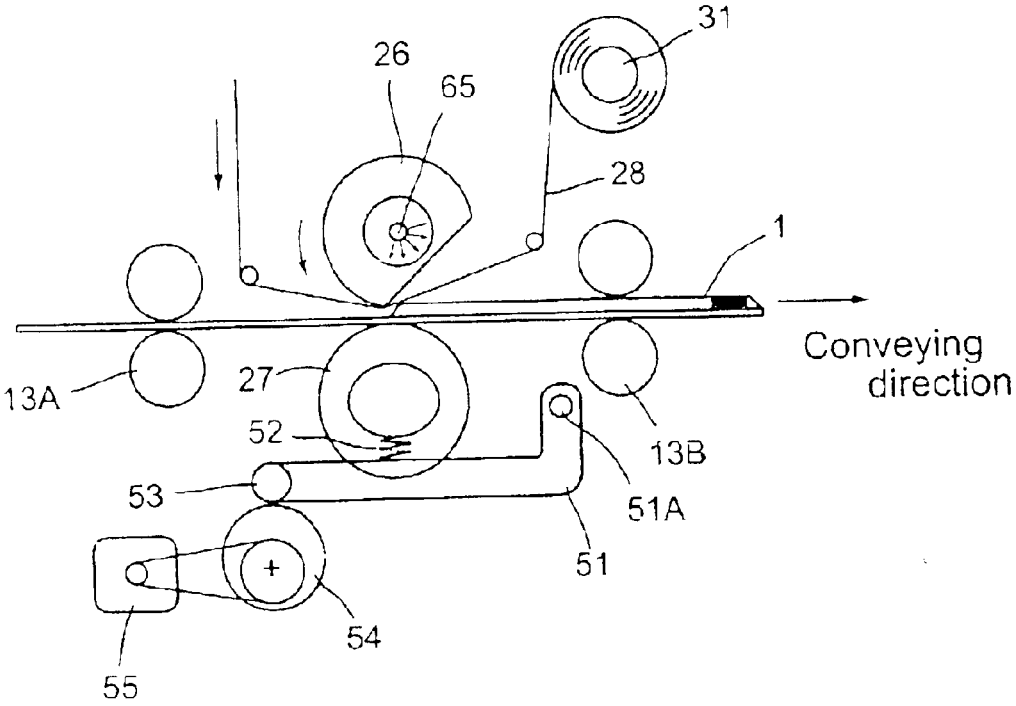
FIG. 9A is a diagram for explaining the transferring operation when transferring information on an image receiving medium that is not thick.

That is, when transferring prescribed information printed on the intermediate transfer ribbon 28 on a thin print page of an image receiving medium 1, for example, a passbook 1, make the rotating amount of the arm 51 upward large by the cam 54 and the cam follower 53 and bring the back-up roller 27 close to the heat roller 26 as shown in FIG. 9A. As a result, the gap between the heat roller 26 and the back-up roller 27 is relatively narrowed. Then, when transferring information, the back-up roller 27 is pressurized by the spring 52 and the intermediate transfer ribbon 28 between it and the heat roller 26 and the printing page of a passbook 1 are press fit by a prescribed pressure.

Figure 9B:
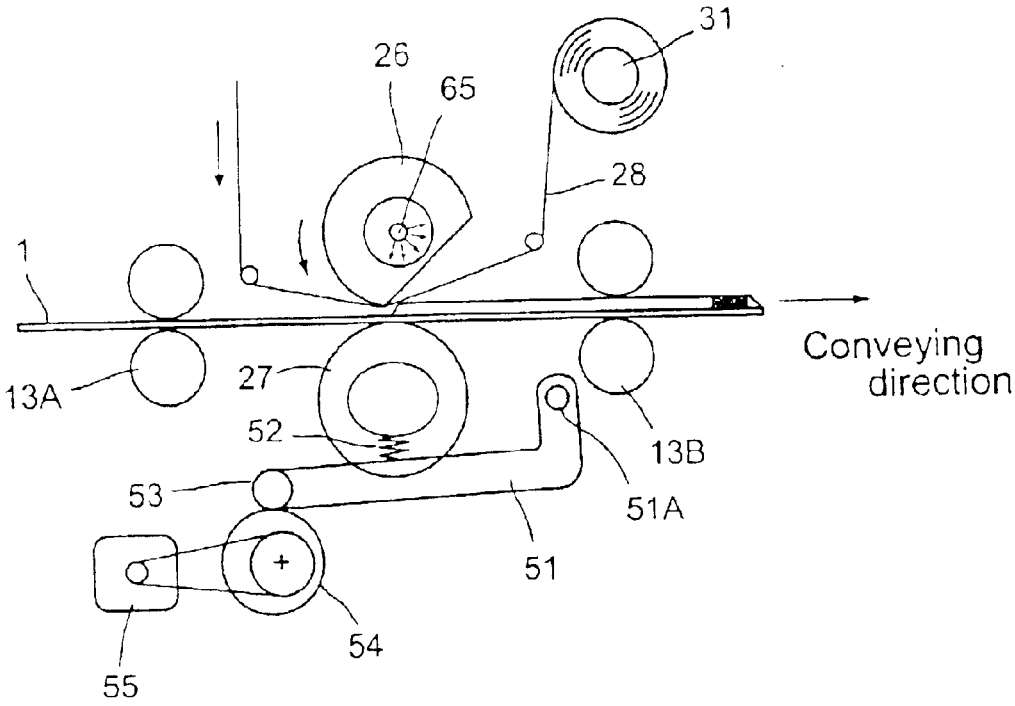
FIG. 9B is a diagram for explaining the transferring operation when transferring information on an image receiving medium that is thick.

On the other hand, when transferring prescribed information printed on the intermediate transfer ribbon 28 on a thick image receiving medium 1, for example, a passbook 1, make the rotating amount of the arm 51 upward smaller than the case shown in FIG. 9A by the can 54 and the cam follower 53 as shown in FIG. 9B, and make the gap between the heat roller 26 and the back-up roller 27 relatively wide. Then, pressurize the back-up roller 27 by the spring 52 and press fit the intermediate transfer ribbon 28 and the printing page of a passbook 1 between the heat roller by a prescribed pressure at the same level as in the thin image receiving medium 1 shown in FIG. 9A.

At this time, the transfer by the heat roller 26 is started from the point near the seam of a passbook 1 and the prescribed information printed on the adhesion layer 42 in the intermediate transfer ribbon 28 is press fitted on the printing page 10 of a passbook 1 by the arc portion 35B of the heat roller 26. Thus, the hologram layer 41, the adhesion layer 42 and the prescribed information printed on the adhesion layer 42 are transferred on the printing page 10 of a passbook 1.

Figure 10A:
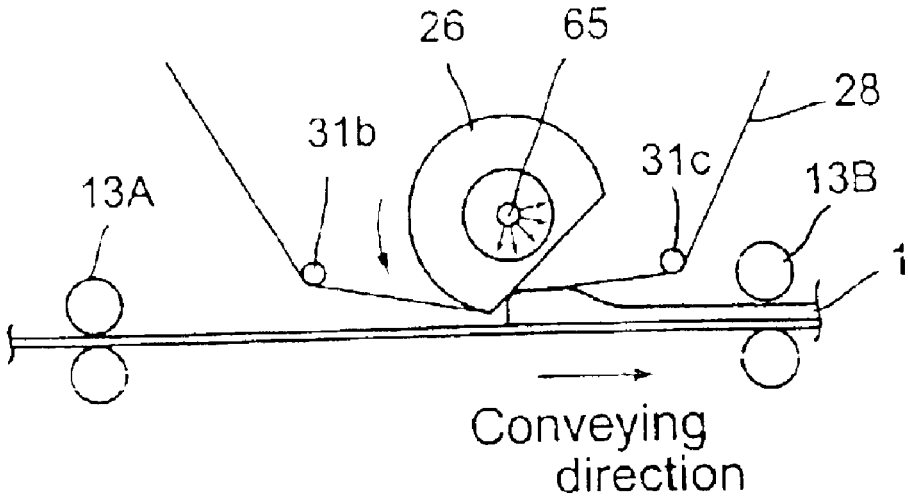
FIG. 10A is a diagram for explaining the swelling generated near the seam when making the transfer on an image receiving medium with a page opened.

Further, in a case where a passbook 1 with a prescribed printing page opened is an image receiving medium 1, the swelling may be generated especially near the seam on the surface of the printing page when starting the transferring operation from that point as shown in FIG. 10A. In order to cope with this, in this embodiment the CPU 70 rotates the first and second conveying roller pairs 13A and 13B in the reverse direction each other by controlling the medium conveying controller 78 before starting the transferring operation.

Figure 10B:
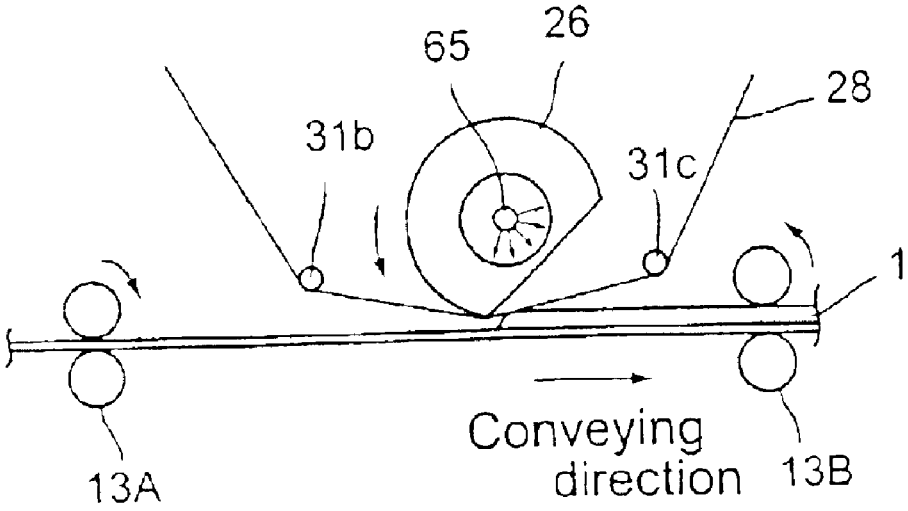
FIG. 10B is a diagram for explaining the operation to suppress the swelling generated near the seam.
Figure 11:
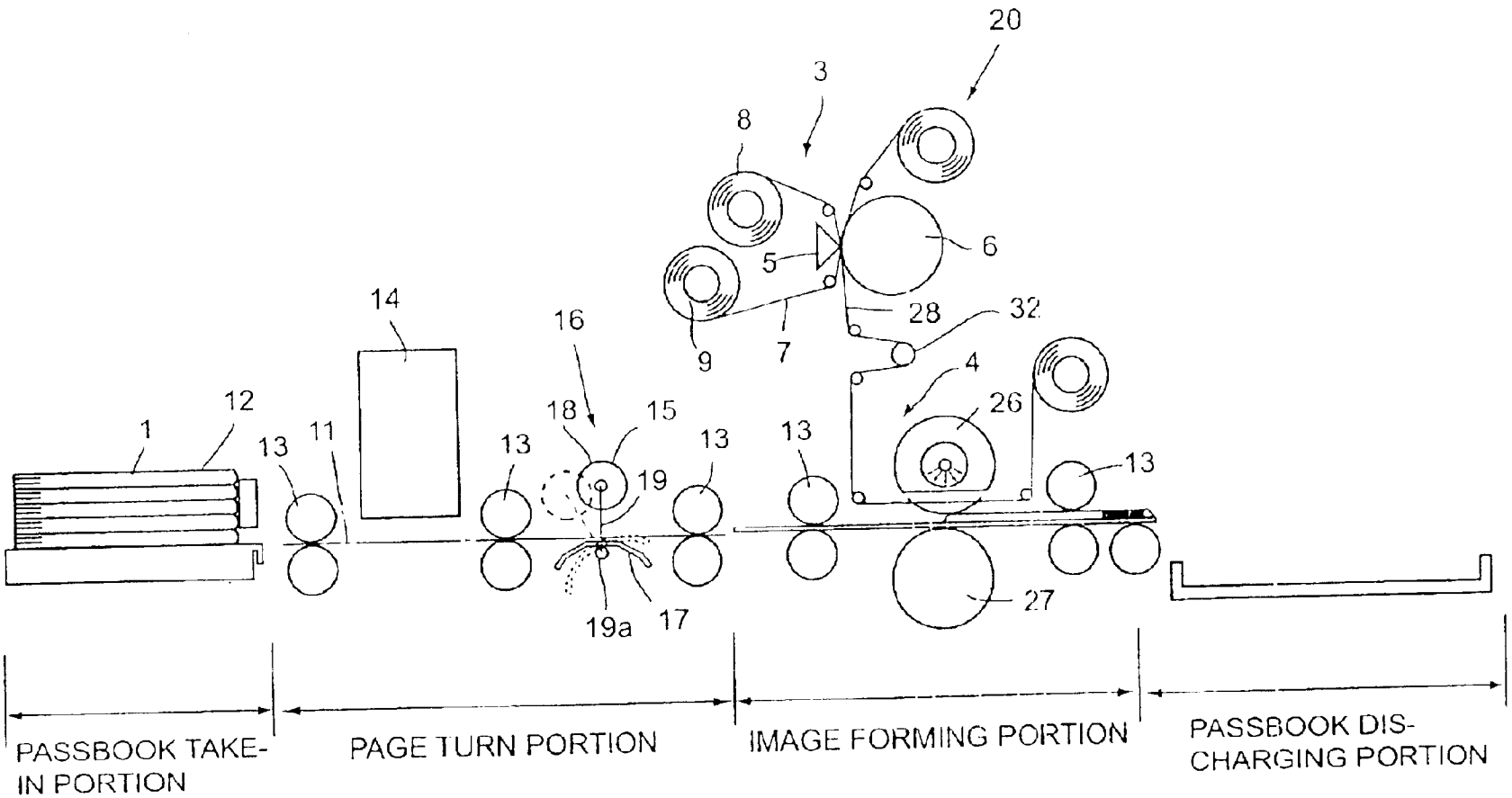
FIG. 11 is a schematic diagram showing the structure of a printer system applied with the printing device shown in FIG. 1.

That is, the medium conveying controller 78 rotates the first conveying roller pair 13A in the forward direction likewise when supplying an image receiving medium 1 in the printing device and rotates the second conveying roller pair 13B in the reverse direction likewise when discharging an image receiving medium 1 from the printing device. Thus, it becomes possible to suppress the slackening generated on the surface of a passbook 1 and make the transfer smoothly on the printing page 10 as shown in FIG. 10B.

Figure 8D:
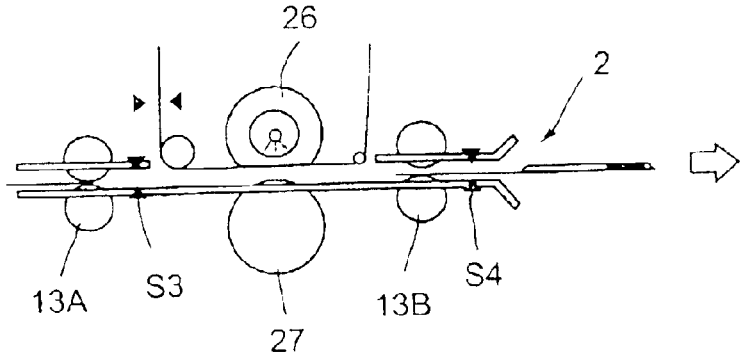

Then, the CPU 70 drives the first conveying roller pair 13A and the second conveying roller pair 13B by controlling the medium conveying controller 78, and discharges the transfer completed passbook 1 from the take-in port 2 as shown in FIG. 8D.

By the printing operation and the transferring operation described above, it becomes possible to print prescribed data on the printing page 10 of the passbook 1 and cover the whole surface of the printing area 10A with peculiar prescribed data printed by a protection film having the diffraction effect.

Next, the printing system equipped with the printing device described above will be explained.

That is, this printing system has a passbook take-in portion 12 that houses plural closed passbooks 1 in the stacked state and takes in the passbooks one by one and a conveying path 11 extending in the right direction from this passbook take-in portion 12 as shown in FIG. 9. On the conveying path 11, there are plural conveying roller pairs 13 provided for conveying the passbooks 1 taken in from the passbook take-in portion 12 in both the forward and reverse directions. In the following explanation, the right direction from the passbook take-in portion 12 toward the printing apparatus in FIG. 9 is regarded as the forward direction and the opposite direction as the reverse direction.

Further, this printing system is equipped with a page sensor 14 for detecting the opened printing page 10 of a passbook 1, a page turn over portion 16 having a page turn over mechanism 15, and the printing device 20 for printing prescribed information on a passbook 1 with a prescribed page opened by the page turn over portion 16 along the conveying path 11. The printing device 20 is in the same structure of the printing device 20 described above and therefore, the detailed explanation thereof will be omitted here.

The page sensor 14 detects an image on the opened printing page of a passbook 1, reads a bar code (not shown) given to a prescribed position of that page based on its image data and recognizes the opened page of a passbook 1.

The page turn over mechanism 15 has a back up plate 17 provided below the conveying path 11, a turn over roller 18 provided above the conveying path 11 and a swing shaft 19 that rotates freely centering around a fulcrum 19*a* provided to the back up plate 17 and is mounted with the turn over roller 18 rotatably at its swing end. When the swing shaft 19 is swung by a motor (not shown) to a position shown by the broken line in the figure, the turn over roller 18 is swung and the back up plate 17 is also swung in conjunction with the turn over roller 18. Further, the turn over roller 18 can be rotated clockwise or counterclockwise by the motor (not shown).

When the page of a passbook 1 is turned over by the page turn over mechanism 15, a passbook 1 is first conveyed to a prescribed position in the page turn over mechanism 15 and stopped there and then, for example, the swing shaft 19 is swung leftward as shown by the broken line in the figure, and the turn over roller 18 is pushed against a passbook 1. At this time, the back-up plate 17 is also swung pursuant to the swing of the swing shaft 19 and the back surface of the passbook 1 is pushed upward by the inclined back-up plate 17.

Under this state, the turn over roller 18 pushed against a page at the upper stream side in the conveying direction of a passbook 1 is rotated and the turn over operation of the top page of the passbook 1 is started. By this turn over operation, the applicable page is swelled as if pushed up and the turn over roller 18 is stopped when the page is turned over to the some extent. Further, after the swing shaft 19 is moved back to the position shown by the solid line in the figure from this state, the turn over roller 18 is rotated again and the said page is completely turned over on the turn over roller 18.

Then, the passbook 1 is conveyed in the reverse direction, the turned over page on the turn over roller is opened completely, image data on the opened page is detected by the page sensor 14 and further, by reading a bar code, the opened page is confirmed. As a result, it becomes possible to open a desired page of the passbook 1 automatically and confirm the opened page. Thus, the passbook 1 of which kind is recognized and desired page is opened is conveyed to the printing device 20 wherein prescribed information is printed and a protection film is transferred on its surface.

Further, by operating the operation of the page turn over mechanism 15 described above in the reverse order, it is possible to open pages of the passbook 1 in the reverse direction.

The passbook 1 that has prescribed data printed in the printing device 20 is further conveyed toward the downstream side in the conveying direction and discharged into a passbook discharging port.

According to such a printing system as described above, it becomes possible to automatically prepare a passbook 1 having printed prescribed data continuously.

As explained above, according to this printing device and the printing method, by printing prescribed information on the image layer (the adhesion layer) of the intermediate transfer ribbon and transferring the adhesion layer together with the prescribed data on an image receiving medium, it becomes possible to make the high quality printing stably without affected by the surface condition of an image receiving medium.

Further, it becomes possible to press fit an image receiving medium and the intermediate transfer ribbon at a fixed pressure irrespective of a thickness of an image receiving medium at the time of transferring information, and also, it becomes possible to prevent defective conveyance of an image receiving medium and the intermediate transfer ribbon, and generation of defective transferring of prescribed information printed on the intermediate transfer ribbon on an image receiving medium.

Furthermore, it becomes possible to prevent generation of defective transfer by suppressing the swelling of the surface of an image receiving medium when transferring information.

In the embodiment described above, the pressurization mechanism was constructed so as to move the back-up roller close to/separate from the heat roller and apply a fixed pressure irrespective of a thickness of an image receiving medium. However, the pressurization mechanism may be so constructed that the back-up roller is made stationary and apply a fixed pressure irrespective of a thickness of an image receiving medium by moving the heat roller close to/separate from the back-up roller. Further, the pressurization mechanism also may be constructed so as to apply a fixed pressure irrespective of a thickness of an image receiving medium by making the heat roller and the back-up roller movable.

As explained above, according to this invention, it is possible to provide a printing device and a printing method capable of preventing generation of defective conveyance and defective transfer, and also capable of assuring the printing/transferring of prescribed information on prescribed positions of an image receiving medium and executing the high quality image printing stably irrespective of the surface state of an image receiving medium.

Next, the printing device and the printing method in a second embodiment of this invention will be explained referring to FIG. 12–FIG. 16.

Figure 12:
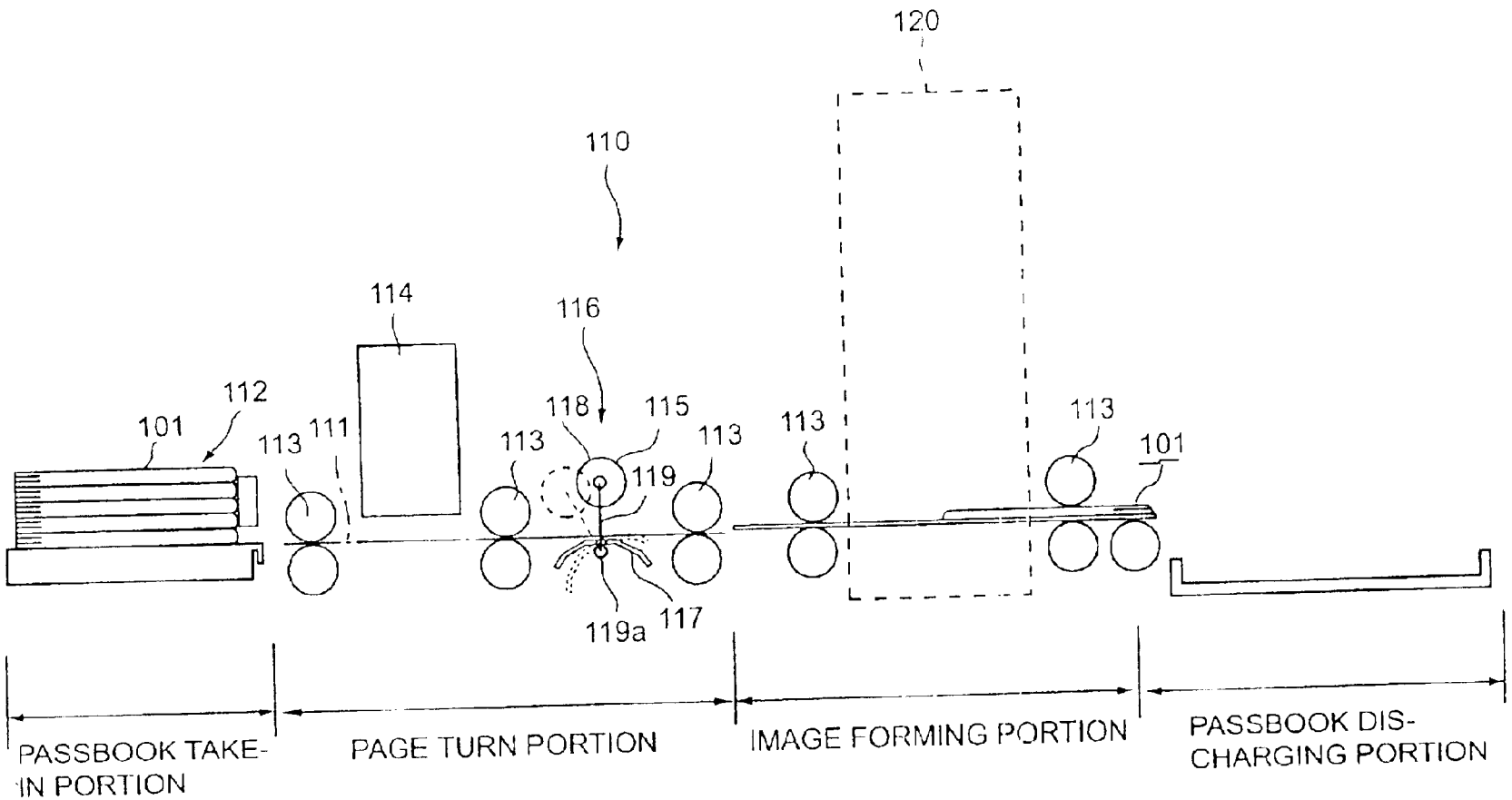
FIG. 12 is a schematic diagram showing a passbook printing system provided with the printing device in a second embodiment of this invention.

FIG. 12 shows a passbook printer system 110 (hereinafter, simply referred to as a system 110) incorporating a printer device 120 for printing such information as name, address, etc. a photograph of a bearer on an image receiving medium, for example, a passbook 101.

The system 110 has a passbook take-in port 112 that houses plural closed state passbooks 101 in the stacked state and supplies passbooks one by one into the system 110 and a conveying path 111 extending in the right direction in FIG. 12 from the passbook take-in port 112. On the conveying path 111, plural conveying roller pairs 113 (conveying mechanism) for conveying the passbook 101 taken in from the passbook take-in port 112 are provided. In the explanation shown below, the right direction in FIG. 12 toward the printer device 120 that is described later from the passbook take-in port 112 is regarded as the forward direction and the opposite direction is regarded as the reverse direction.

The system 110 has a page sensor 114 for detecting the opened page of a passbook 101, a page turn over portion 116 having a page turn over mechanism 115, an image forming portion equipped with the printer device 120 of this invention for printing prescribed information on a passbook 101 with a prescribed page opened, and a passbook discharging portion for discharging a passbook with information printed on a desired page.

The page sensor 114 detects an image on a opened page of a passbook 101 and sends this image data to a controller 150 that is described later. In the controller 150, an opened page of a passbook 101 is recognized from a bar code (not shown) given to a prescribed position of that page based on the image data.

The page turn over mechanism 115 has a back-up plate 117 provided below a conveying path 111, a turn over roller 118 provided above the conveying path 111, and a swing shaft 119 that swings centering around a fulcrum 119*a* provided at the swinging center of the back-up plate 117 and has a turn over roller 118 mounted to its swing end to freely revolve. When the swing shaft 119 is swung by a motor (not shown) at a position shown by the broken line in FIG. 12, the turn over roller 118 is swung and the back-up plate 117 is swung in conjunction with the turn over roller 118. Further, the turn over roller 118 is able to revolve in the clockwise or counterclockwise direction by a motor (not shown).

When turning over pages of a passbook 101 by the page turn over mechanism 115, the passbook 101 is first conveyed to a prescribed position in the page turn over mechanism 115 and stop there, and the turn over roller 118 is pushed against the passbook 101, for example, by swinging the swing shaft 119 in the left direction as shown by the broken line in FIG. 12. At this time, with the swinging of the swing shaft 119, the back-up plate 117 is also swung and the back of the passbook 101 is pushed upward by the tilted back-up plate 117.

Under this state, the turn over roller 118 pushed against the page at the upper stream side of the passbook 101 in the conveying direction is rotated and the turn over operation of the top page of the passbook 101 is started. By this page turn over operation, the page is pushed up and to swell and stopped when turned over to some extent, the turn over roller 118 is stopped. Further, after the swing shaft 119 is returned to a position shown by the solid line in the figure from this state, that page is completely turned over on the turn over roller 118 by rotating the turn over roller 118 again.

Then, the passbook 101 is conveyed in the reverse direction, the page turned over on the turn over roller 118 is fully opened, the image data on the opened page is detected by the page sensor 114, and the opened page is confirmed by reading a bar code. Thus, it becomes possible to open a desired page of the passbook 101 automatically and recognize the opened page by reading a bar code. The passbook with the desired page opened is conveyed to the printer device 120 that will be described later and prescribed information is printed on a desired page.

Further, it is possible to open pages of the passbook 101 in the reverse direction by operating the page turn over mechanism 115 conversely.

Figure 13:
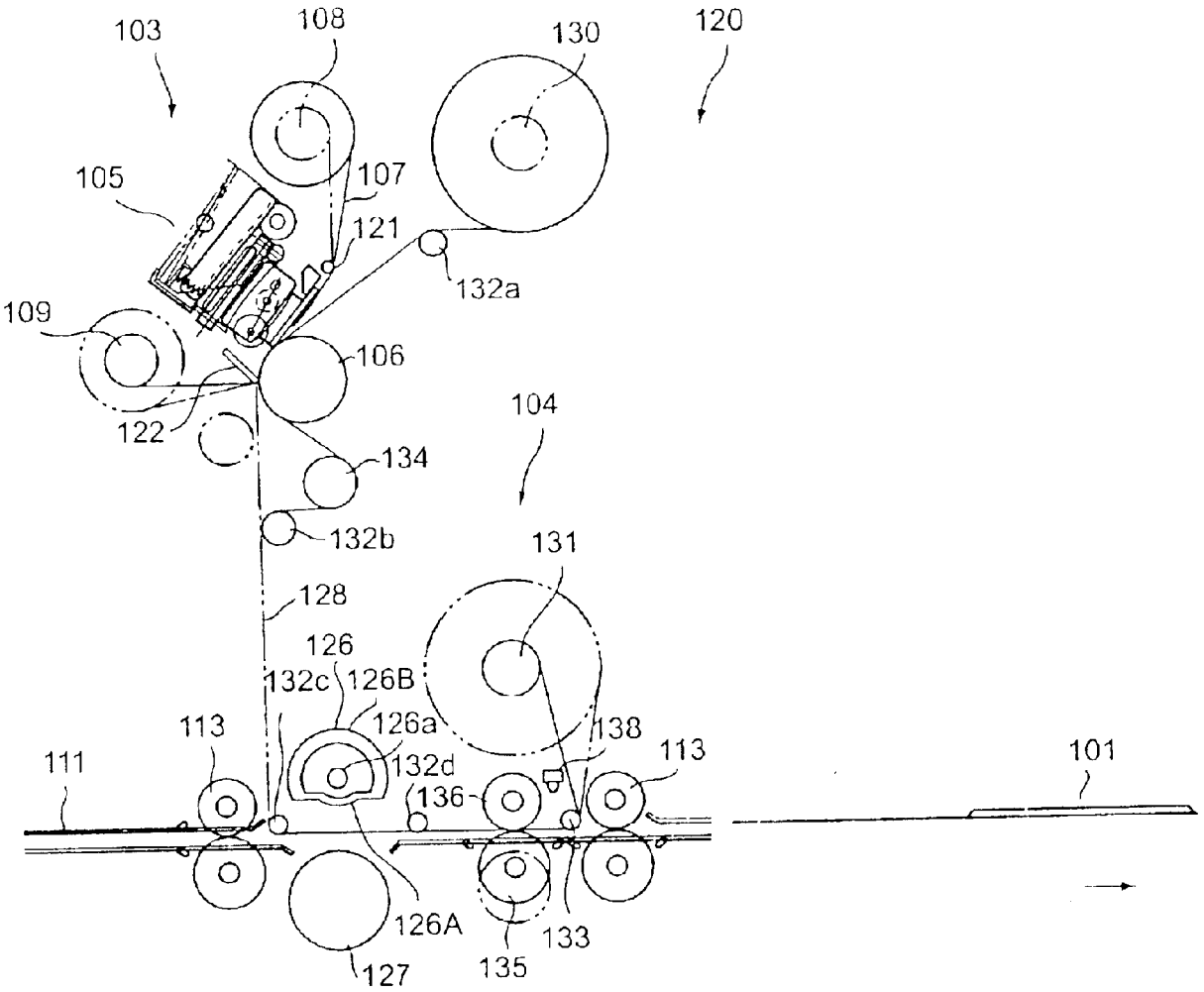
FIG. 13 is a schematic diagram showing the structure of the printing device incorporated in the system shown in FIG. 12.

FIG. 13 is an enlarged view showing the structure of the printer device 120.

The printer device 120 has a printer portion 103 and a transferring/separating portion 104 provided below this printer portion 103.

The printer portion 103 has a thermal print head 105 and facing this thermal print head 105, a platen roller 106 is provided. Between the thermal print head 105 and the platen roller 106, there is an ink ribbon 107 with, for example, Y (yellow), M (magenta), C (cyan) and K (black) color melding inks periodically coated. One end of the ink ribbon 107 is wound round a supply shaft 108 and the other end is wound round a take-up shaft 109. The middle portion of the ink ribbon 107 is put over guide members 121 and 122.

Further, the ink ribbon 107 can be a ribbon using a single color only or fluorescent pigment ink that becomes luminous when applied with ultraviolet rays or ribbon materials having such functions as metal thin film layer (aluminum vaporized) for printing having a glossy surface or hologram layer for printing.

On the other hand, the transferring/separating portion 104 is provided with a heat roller 126 as a transferring portion, and a back-up roller 127 is positioned below this heat roller 126 facing it. The heat roller 126 has a heater 126*a* in its inside and the outer surface is formed in a partially flat D shaped section. The length of the remaining arc area 126B of the heat roller 126 is nearly the same as the length of an image transferring area along the conveying direction of a passbook 101. The image transferring area denotes an image formable area in the pages of a passbook 101.

Between the heat roller 126 and the back-up roller 126, there is an intermediate transfer ribbon 128 as an intermediate transfer ribbon. The intermediate transfer ribbon 128 has a long base film composed of a polyester material and transferring layers composed of polyester resin are coated sequentially via separating layers composed of phenoxy resin on the surface of this base film. An image is printed on the transferring layer 103 via the printer portion 103 described above. A printed image is transferred on a prescribed page of a passbook 101 and therefore, the transferring layer is transferred on the passbook 101 together with an image separated from the base film.

Further, when the intermediate transfer ribbon 128 is provided with such a functional layer as a hologram layer, a fluorescent luminous layer that becomes luminous by the ultraviolet rays, these functional layers also can be transferred based on the image transfer to a passbook 10*o*1.

One end of the intermediate transfer ribbon 128 is wound round a supply shaft 130 provided neat the printer portion 103 and the other end is wound round a take-up shaft 131 provided near the transferring/separating portion 104. The middle portion of the intermediate transfer ribbon 128 is put over the platen roller 106, guide shafts 132*a*~132*d*, a separation shaft 133 (a separation member), and a ribbon tensioner 134. In other words, the intermediate transfer ribbon 128 is given with a prescribed tension by the ribbon tensioner 134 that is constantly biased in the arrow direction shown in FIG. 13, and is provided between the outer surface of the platen roller 106 and the ink ribbon 107 in the printer portion 103. Further, the intermediate transfer ribbon 128 is extending in parallel with the conveying path 111 above it between two sets if the conveying roller pairs 113 and 113.

When the heat roller 126 is waiting for the printing, the almost flat cut surface 126A of the heat roller 126 is facing the conveying path 111 parallel via the intermediate transfer ribbon 128 (in a posture shown in FIG. 13). As a result, a gap is formed between the heat roller 126 and the back-up roller 127. At this time, it is desirable that the intermediate transfer ribbon 128 is not in contact with the heat roller 126 and the back-up roller 127 and is arranged at a position kept away from the surface of a passbook 101 that is coming when starting the printing.

Further, at the right side of the heat roller 126 in FIG. 13; that is, at the downstream side in the conveying direction of a passbook 101, a pair of maintain rollers 135 and 136 (a maintaining mechanism) for maintaining a passbook 101 conveyed on the conveying path 111 in the close fitted state by clamping it together with the intermediate transfer ribbon 128 are provided. The maintain roller 135 provided below the conveying path 111 is able to contact to/separate from the maintain roller 136 provided above the conveying path 111. The maintain rollers 135 and 136 are rotated following the run of a passbook 101 and the intermediate transfer ribbon 128 or through a torque limiter (not shown).

Further, behind the nip between a pair of maintain rollers 135 and 136, there is provided a radiation temperature sensor 138 (a detector) for detecting a temperature of the transferring layer that is transferred on the image transfer area of a passbook 101 conveyed through the conveying path 111. The radiation temperature sensor 138 detects a temperature without contacting a passbook 101 and the intermediate transfer ribbon 128.

Further, a separation shaft 133 with the intermediate transfer ribbon wound round is arranged at a position away by a distance (T shown in FIG. 16) at least longer than the length (t shown in FIG. 16) along the conveying direction of the transferring layer transferred on a passbook 101 passed the transfer area between the heat roller 126 and the back-up roller 127. More simply, the separation shaft 133 is provided at a position wherein the transfer layer transferred on a passbook 101 passed the transfer area can be stopped and maintained tentatively at the upper stream side of the separation shaft 133. Further, a space at the downstream side in the conveying direction from the transfer area and at the upper stream side from the separation shaft 133 functions as a reserving portion of this invention.

Figure 14:
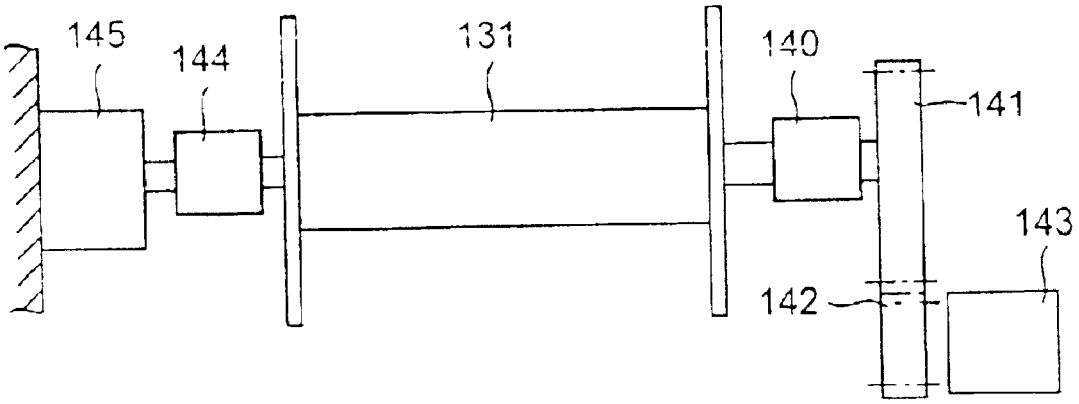
FIG. 14 is a diagram schematically showing the driving structure of a take-up shaft of the intermediate transfer medium incorporated in the printing device shown in FIG. 13.

The take-up shaft 131 of the intermediate transfer ribbon 128 is connected with a torque limiter 140 and a pulse motor 143 via mutually meshed two gears 141 and 142 as shown in FIG. 14. Further, a rotary encoder 145 for detecting an actual rotating speed of the take-up shaft 131 is mounted to the other end of the take-up shaft 131 via coupling 144.

To give an adequate tension to the intermediate transfer ribbon 128, the pulse motor 143 tries to rotate the take-up shaft 131 at such a speed that the running speed of the intermediate transfer ribbon 128 becomes faster than the running speed of the ink ribbon 107 of the printer portion 103 and the conveying speed of a passbook 101 being conveyed on the conveying path 111. However, the intermediate transfer ribbon runs at the same speed as the conveying speed of the passbook 101 by the action of the torque limiter 140. On the other hand, when the intermediate transfer ribbon 128 is run at a fixed speed, the rotating speed of the take-up shaft 131 is changed corresponding to the diameter of the intermediate transfer ribbon 128 wound round the take-up shaft 131. In other words, the wound diameter of the intermediate transfer ribbon 128 wound round the take-up shaft 131 can be measured by detecting the actual rotating speed of the take-up shaft by the rotary encoder 145.

Figure 15:
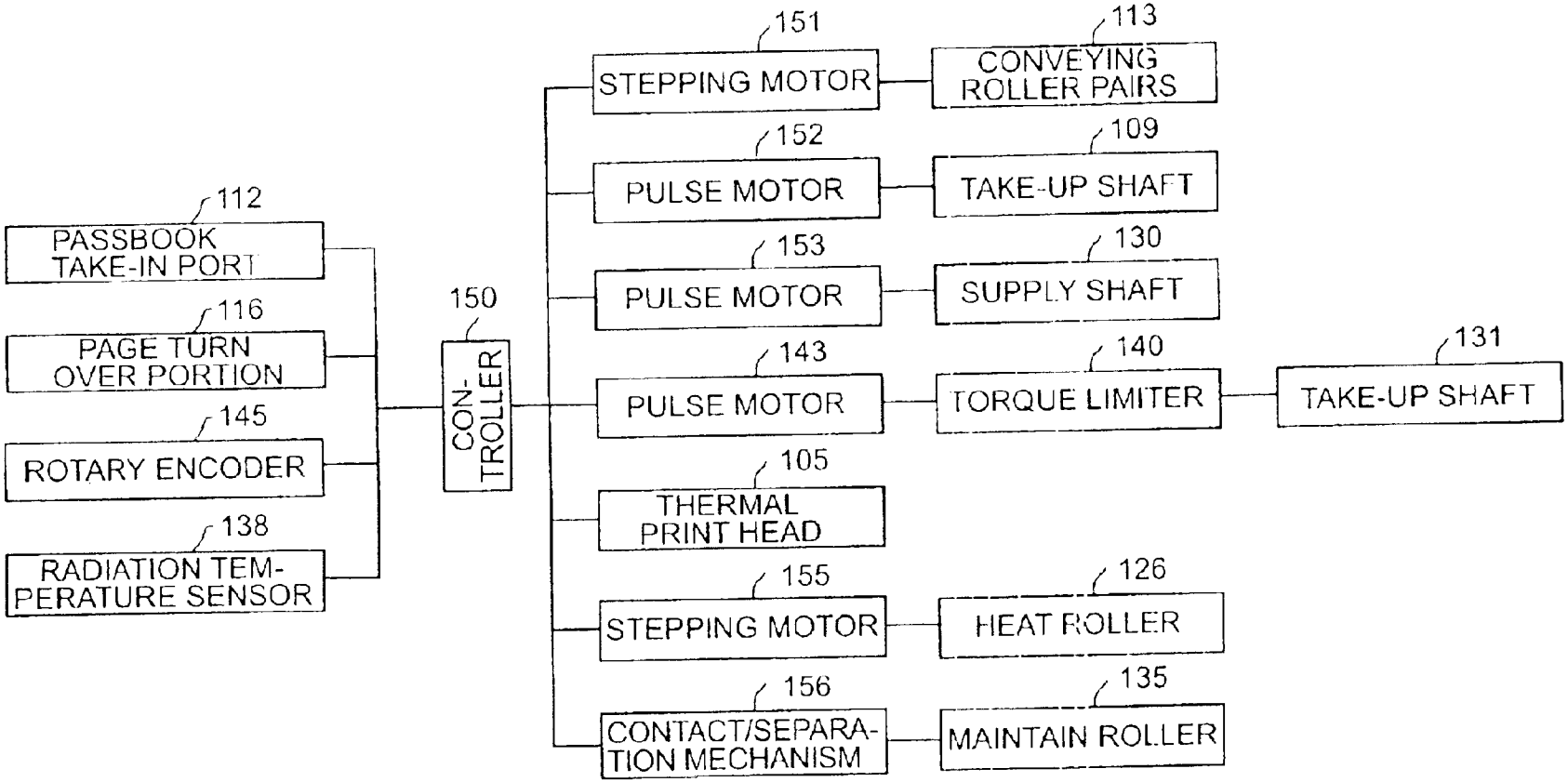
FIG. 15 is a block diagram showing the control system that controls the operation of the system shown in FIG. 12.

FIG. 15 is a block diagram showing the control system for controlling the operation of the system 110 including the printer device 120 in the structure described above.

The controller 150 of the system 110 is connected with component elements of the passbook take-in port 112 and the page turn over portion 116. Further, the controller 150 is connected with a stepping motor 151 for rotating plural conveying roller pairs 113 in the forward and reverse directions for conveying the passbook 101 through the conveying path 111.

Further, the controller 150 is connected with the pulse motor 152 for rotating the take-up shaft 109 for winding the ink ribbon 107 of the printer portion 103, a pulse motor 153 for rotating the supply shaft 130 for supplying the intermediate transfer ribbon 128 in the supply direction and the take-up direction, and a pulse motor 143 for rotating the take-up shaft 131 for winding the intermediate transfer ribbon 128.

Further, the controller 150 is connected with the thermal print head 105 of the printer portion 103, a stepping motor 155 for rotating the heat roller 126, a rotary encoder 145 mounted to the take-up shaft 131 of the intermediate transfer ribbon 128, a contact/separation mechanism 156 to contact/separate the maintain roller 135 to/from the maintain roller 136, and the radiation temperature sensor 138.

The pulse motor 143 for rotating the take-up shaft 131 of the intermediate transfer ribbon 128 functions as a running mechanism of this invention together with the take-up shaft 131. In addition, the pulse motor 143 also functions as a separation mechanism of this invention together with the above-mentioned separation shaft 133, take-up shaft 131, plural conveying roller pairs 113, and stepping motor 151.

Figure 16:
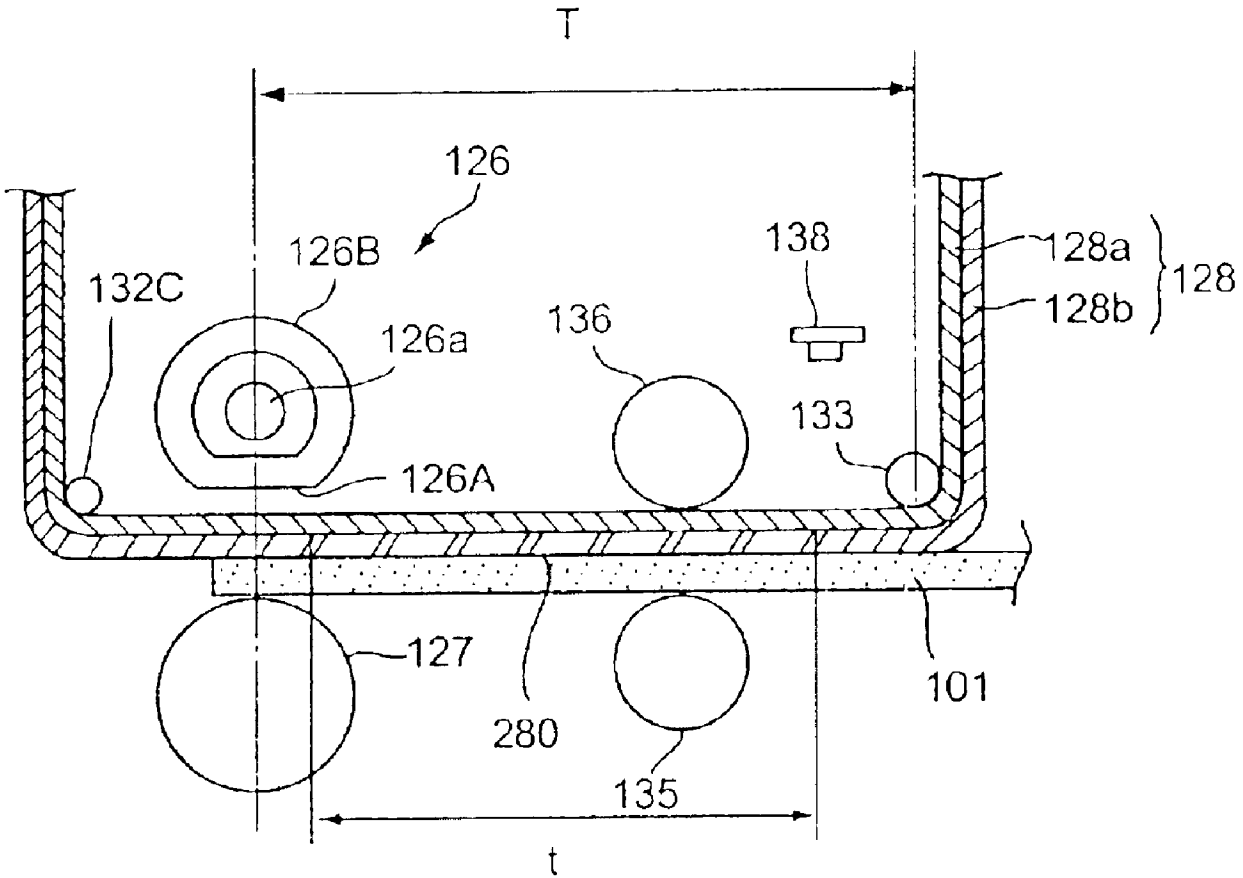
FIG. 16 is a diagram for explaining the transferring/separating operation by the printing device shown in FIG. 13.

Next, the operation of the printer device 120 will be explained referring mainly to FIG. 13 and FIG. 16.

In the waiting state before the operation, the heat roller 126 is set so as to face its cut surface 126A to the conveying path 111 and the maintain roller 135 is kept separated from the maintain roller 136. Further, the heat roller 126 is heated to a prescribed temperature (150° C. in this embodiment) by applying electric power to the heater 126*a*.

Under this state, the ink ribbon 107 and the intermediate transfer ribbon 128 are pushed against the platen roller 106 by the thermal print head 105, the platen roller 106 is rotated at a prescribed speed, the intermediate transfer ribbon 128 and the ink ribbon 107 run, and an image is printed on the transferring layer 128*b* of the intermediate transfer ribbon 128 by the thermal print head 105. And at the same time, the take-up shaft 109 of the ink ribbon 107 and the take-up shaft 131 of the intermediate transfer ribbon 128 are rotated and the ink ribbon 107 and the intermediate transfer ribbon 128 conveyed by the platen roller 106 are taken up. The printed image is conveyed into the transferring area between the heat roller 126 and the back-up roller 127 as the intermediate transfer ribbon 128 runs and stopped at a prescribed transferring position.

As this time, the take-up shaft 131 of the intermediate transfer ribbon 128 is rotated at a rotating speed so that the intermediate ribbon 128 runs at a speed faster than the running speed by the platen roller 106. Actually, however, the take-up shaft 131 is rotated at the running speed by the platen roller 196 by the action of the torque limiter 140. The actual rotating speed of the take-up shaft 131 of the intermediate transfer ribbon 128 is detected by the rotary encoder 145 in the controller 150, and the wound diameter of the intermediate transfer ribbon 128 taken up by the take-up shaft 131 is detected.

On the other hand, a passbook 101 with a prescribed page opened is conveyed through the conveying path 111 and stopped when the leading edge of a page on which an image is to be formed comes right below the heat roller 126. Hereafter, the maintain roller 135 is moved up toward the maintain roller 136 and set at a position shown by the solid line in the figure. Then, when the heat roller 126 is rotated, the conveying roller pair 113 are also rotated at the same time, and the arc area 126B is pushed against the passbook 101 via the intermediate transfer ribbon 128 having a printed image. At this time, the take-up shaft 131 is rotated at a rotating speed based on the pre-detected take-up diameter and the intermediate transfer ribbon 128 is run at the same speed as the conveying speed of the passbook 101.

Thus, the intermediate transfer ribbon 128 is heated and pushed against to the passbook 101, and the portion 280 of the transferring layer 128*b* having the printed image is transferred on the passbook 101 together with the printed image. The state immediately after the image transfer is shown in FIG. 16. After transferring an image, the take-up shaft 131 is stopped to rotate, the intermediate transfer ribbon 128 is stopped and at the same time, the rotation of the conveying roller pair 113 is stopped and the movement of the passbook 101 is stopped. In this state, the passbook 101 and the intermediate transfer ribbon 128 are clamped and close fitted by a pair of the maintain rollers 135 and 136. Further, the cut surface 126A of the heat roller 126 is rotated to a posture facing the conveying path 111 and stopped for the next processing.

In this invention, the separation shaft 133 is arranged at a position where a distance T from the transferring portion where the heat roller 126 and the back-up roller 27 are facing each other to the separation shaft 133 becomes at least longer than a length t of the transferring layer 280 transferred on the passbook 101 along the conveying path and therefore, the transferring layer 280 transferred on the passbook 101 is stopped on the conveying path 111 at the upper stream side from the separation shaft 133 in the conveying direction.

Then, the temperature of the transferring layer 280 is monitored by the radiation temperature sensor 138 and on the assumption that the transferring layer 289 is cooled down to a preset temperature (50° C. in this embodiment), the conveyance of the passbook 101 is started again and the running of the intermediate transfer ribbon 128 is started again. At this time, the take-up shaft 131 is rotated at a rotating speed based on the wound diameter of the intermediate transfer ribbon and the running speed of the intermediate transfer ribbon 128 becomes the same as the conveying speed of the passbook 101.

The intermediate transfer ribbon 128 is directed in the direction differing from the conveying direction of the passbook 101 at the position of the separation shaft 133. As a result, the intermediate transfer ribbon 128 is separated from the passbook 101 and the transferring layer 280 including the image transferred on the passbook 101 and the base film 128*a* of the intermediate transfer ribbon 128 are separated.

After separated, the supply shaft 130 of the intermediate transfer ribbon 128 is rotated in the direction (the reverse direction) to take up the ribbon as necessary and the intermediate transfer ribbon 128 is taken up by a specified distance. In other words, the portion at the upper stream side of the intermediate transfer ribbon 128 from the portion less the transferring layer 128*b* from the base film 128*a* is usable. Therefore, the intermediate transfer ribbon 128 is taken up to the position where this portion is facing the thermal print head 105.

As described above, according to this invention, the separation shaft 133 for separating the intermediate transfer ribbon 128 and a passbook 101 is arranged at the downstream side separated sufficiently from the heat roller 126. Therefore, the transferring layer 280 including an object image after transferred can be stopped and reserved at the upper stream side of the separation shaft 133. As a result, it is no longer required to separate the intermediate transfer ribbon 128 and a passbook 101 immediately after transferring the transferring layer 280 on the passbook 101 and the transferring layer 280 can be separated after sufficiently cooled down.

Thus, when the intermediate transfer ribbon 128 and the passbook 101 are separated each other after the transferring layer 280 is cooled sufficiently, the transferring layer 280 can be separated from the base film 128*a* satisfactorily and it becomes possible to prevent such defects that the passbook 101 that is press fitted to the transferring layer 280 is pulled by the intermediate transfer ribbon 128 or broken. Further, as the intermediate transfer ribbon and the passbook 101 can be separated satisfactorily, the degree of freedom in selecting materials for the passbook 101 increases and paper of relatively weak stiffness can be used.

Furthermore, the wound diameter of the intermediate transfer ribbon taken by the take-up shaft 131 is detected by detecting the actual rotating speed of the take-up shaft 131 of the intermediate transfer ribbon and based on this wound diameter, the rotating speed of the take-up shaft 131 is controlled in this invention. Therefore, it is possible to take up the intermediate transfer ribbon 128 so that the running speed of the intermediate transfer ribbon 128 is constantly kept at the same speed even if the wound diameter of the intermediate transfer ribbon taken by the take-up shaft 131 is changed. As a result, when separating the intermediate transfer ribbon 128 from the passbook 101, the running speed of the intermediate transfer ribbon can be controlled at the same conveying speed of the passbook 101, and the intermediate transfer ribbon 128 can be separated from the passbook 101 satisfactorily without generating a undesirable shear stress.

This invention is not restricted to the embodiment described above but can be modified variously without departing from the spirit and scope thereof.

As explained above, the printer device of this invention has the structure and action as described above, the degree of freedom in selecting an image receiving medium can be improved and an intermediate transfer ribbon and an image receiving medium can be separated satisfactorily.

What is claimed is:

1. A printer device comprising:

first conveying means for conveying an intermediate transfer medium provided with a transferring layer having a prescribed pattern;

printing means for printing prescribed information on the transferring layer of the intermediate transfer medium conveyed by the first conveying means;

second conveying means for conveying an image receiving medium;

pressurizing means for press fitting the intermediate transfer medium conveyed by the first conveying means and the image receiving means conveyed by the second conveying means at a prescribed pressure;

detecting means having a contacting member which moves vertically to contact a surface of the image receiving medium for detecting a thickness of the image receiving medium by a vertically moving distance of the contacting member;

adjusting means for adjusting the prescribed pressure applied by the pressurizing means to maintain the prescribed pressure at a fixed level according to the detected thickness of the image receiving medium; and transferring means for transferring the transferring layer of the intermediate transfer medium press fitted by the pressurizing means on the image receiving medium together with the prescribed information printed on the transferring layer, wherein the second conveying means includes a first conveying roller pair arranged at the upper stream side in the conveying direction of the image receiving medium to the transferring means;

a second conveying roller pair arranged at the downstream side in the conveying direction; and a drive controller to rotate the first and second conveying roller pairs in the reverse directions each other so as to suppress the swelling of a seam of a prescribed opened page of the image receiving medium.

2. The printer device according to claim 1, wherein the transferring means includes a heat roller provided with a heating source in it and a back-up roller arranged facing this heat roller, and wherein the adjusting means includes a mechanism for changing a gap between the heat roller and the back-up roller according to a thickness of the image receiving medium.

3. The printer device according to claim 1, wherein the image receiving medium includes a passbook with a prescribed printing page opened, and wherein the transferring means starts the transfer by superposing the intermediate transfer medium on the printing page of the passbook so that the seam becomes in parallel to the crossing direction orthogonal to the conveying direction of the intermediate transfer medium.

4. The printer device according to claim 1, wherein the image receiving medium includes a passbook with a prescribed printing page opened, wherein the transferring means includes a heat roller that has an outer surface which is partially cut in the plane shape and a heating source in it, and wherein the transfer is started with the edge portion of the cut surface brought in contact with the vicinity of a seam of the prescribed printing page of the passbook.

* * * * *